United States Patent [19]

Ino

[11] Patent Number: 4,977,812

[45] **Date of Patent: * Dec. 18, 1990**

[54] ACCOMPANIMENT LINE PRINCIPAL TONE DETERMINATION SYSTEM

[75] Inventor: Mayumi Ino, Akishima, Japan

[73] Assignee: Casio Computer Co., Ltd., Tokyo, Japan

[ * ] Notice: The portion of the term of this patent subsequent to Jan. 30, 2007 has been disclaimed.

[21] Appl. No.: 413,546

[22] Filed: Sep. 27, 1989

Related U.S. Application Data

[62] Division of Ser. No. 224,120, Jul. 25, 1988, Pat. No. 4,896,576.

[30] Foreign Application Priority Data

| | | | |
|---|---|---|---|
| Jul. 30, 1987 | [JP] | Japan | 62-188913 |
| Jul. 30, 1987 | [JP] | Japan | 62-188914 |
| Jul. 30, 1987 | [JP] | Japan | 62-188915 |
| Jul. 30, 1987 | [JP] | Japan | 62-188916 |
| Jul. 30, 1987 | [JP] | Japan | 62-188917 |
| Jul. 30, 1987 | [JP] | Japan | 62-188918 |

[51] Int. Cl.[5] ..... G10H 1/36

[52] U.S. Cl. ..... 84/634; 84/666

[58] Field of Search ..... 84/609–614, 84/618, 634–638, 656, DIG. 2, DIG. 12, DIG. 22, 649–652, 666–669

[56] References Cited

U.S. PATENT DOCUMENTS 4,353,278 10/1982 Adachi .
4,489,636 12/1984 Aoki .
4,499,807 2/1985 Ishida .

FOREIGN PATENT DOCUMENTS 62-67593 3/1987 Japan .
62-67594 3/1987 Japan .

*Primary Examiner*—Stanley J. Witkowski
*Attorney, Agent, or Firm*—Frishauf, Holtz, Goodman & Woodward

[57] ABSTRACT

A system for automatically determining principal tones of an accompaniment line supporting a melodic line comprises a plurality of principal tone inference engines which after principal tones in accordance with different rules of inference from one another and a priority control which controls priorities among the plurality of inference engines to determine final principal tones in the accompaniment line. Each principal tone inference engine may include a condition checker which checks to see whether musical conditions are met and a principal tone generator which generates principal tones. The priority control monitors the information supplied from the condition checkers to select final principal tones supplied from the principal tone generators. Some of the final principal tones may be dependent from the preceding principal tone while some others may be independent. There may be also be provided a storage of the structure of music which is reflected in a series of the final principal tones. In an application, a melodic line monitor is provided so that an accompaniment line interacting with the melody will be generated.

5 Claims, 31 Drawing Sheets

FIG. 3(A)

| ADDRESS | DATA | NUMBER OF MEMBERS |
|---|---|---|
| 1 | 3 | |
| 2 | 1 | Imaj |
| 3 | 5 | |
| 4 | 8 | |
| 5 | X | |
| 6 | 4 | |
| 7 | 1 | I7th |
| 8 | 5 | |
| 9 | 8 | |
| 10 | 11 | |
| 11 | 3 | |
| 12 | 3 | IIm |
| 13 | 6 | |
| 14 | 10 | |
| 15 | X | |

FIG. 3(B)

| | | |
|---|---|---|
| 1 | 1 | I |
| 2 | 7 | IV |
| 3 | 8 | V |
| 4 | 1 | I |
| | ⋮ | |

FIG. 3(C)

| | | |
|---|---|---|
| 1 | 1 | Imaj |
| 2 | 1 | I7th |
| 3 | 3 | IIm |
| 4 | ⋮ | |

DATA FORMAT $A_1$ $A_2$
UPPER DIGIT LOWER DIGIT $A_1$ MEASURE NUMBER $A_2$ REPEAT OR DEVELOPMENT (EXAMPLE) FOR $SB_1$ = 10
$SB_2$ = 91
$SB_3$ = 130

⇩

MUSICAL FORM IS A ----- (MEASURES 1 – 8)
B ----- (MEASURES 9 – 12)
A ----- (MEASURES 13 – )

FIG. 4

KION (I): PRINCIPAL TONE OF BASS FOR I-TH MEASURE

CHORDR (CHORD (I)): ROOT OF CHORD

CHORDN (CHORD (I)): NUMBER OF MEMBERS OF CHORD

CHORDK (CHORD (I), J): J-TH CHORD MEMBER

HN: FIRST MELODY TONE IN SEGMENT OF INTEREST

EN: LAST MELODY TONE IN SEGMENT OF INTEREST

IN (1, J): PITCH OF MELODY TONE

IN (2, J): DURATION OF MELODY TONE

SABI (R): STARTING POSITION AND TYPE OF R-TH PHRASE

NSABI: NUMBER OF PHRASES FORMING MUSIC

Z (SS): WEIGHT OF POINT SS IN MEASURE

SUMO (S): VALUE OF TONE OF PITCH S

OH: MAIN MELODY TONE

FIG. 6

ACCOMPANIMENT LINE PRINCIPAL TONE DETERMINATION SYSTEM

This is a division of Application Ser. No. 07/224,120 filed July 25, 1988, now U.S. Pat. No. 4,896,576.

BACKGROUND OF INVENTION

This invention relates to an accompaniment generation system for automatically generating an accompaniment line supporting a melody tone and more particularly to a system for determining a principle tone for each of a plurality of segments of an accompaniment line.

Technology for automatically generating an accompaniment line such as a bass line or an obbligato line was known. This kind of technique has been developed in the field of electronic musical instruments, and it is incorporated as an automatic accompaniment function of electronic musical instruments. In the prior art automatic accompaniment generation systems, roots are used as principal tones of the accompaniment line. In real-time systems, the source of roots is provided from a music input device such as a keyboard. For example, a certain area of a keyboard is allotted to a chord input key region, and the type and root of each chord is determined from key data input from the key region. Each determined root is used as an accompaniment line principal tone, and an accompaniment pattern is produced on the basis of such a principal tone. The automatic accompaniment line generation techniques are also applicable to nonreal-time type systems. In the nonreal-time type systems, chord progression data is stored in a memory. In operation, chord data is read out for each chord time interval or segment, and the root of each chord constitutes a principal tone of the accompaniment pattern.

The problem of the root approach noted above is that since each principal tone fundamental to the accompaniment line is a root at all time, the line is very poor in variety.

In this viewpoint, the applicant has filed patent applications for a system for automatically generating an accompaniment line in a different approach (Japanese Laid-Open Patent Application Sho 62-67593, Japanese Laid-Open Patent Application Sho 62-67594 both of which were, filed on Sept. 9, 1985 under a title of "Electronic Musical Instrument with Automatic Accompaniment Function"). In the system according to these applications, an adjacent or proximate tone progression is used in lieu of a root progression. More particularly, the automatic accompaniment line generation function has an adjacent tone logic, in which a tone closest to the immediately preceding accompaniment tone among the current chord members is determined to be a current accompaniment tone. Further, Japanese Patent Application Sho 60-207175 shows an improved logic for forming an accompaniment line with adjacent tone moving opposite to a bass line. The adjacent tone logic noted above guarantees that the tone other than the root can be a principal tone. Further, the improvement logic is a contrapuntal or counterpoint approach and is useful for generation of a line with a vivid movement.

However, compared to an accompaniment performance by an excellent player there still remain much room for improvement. One of the features of accompaniment by a human composer or performer is to generate a line in conformity to "musical situation". In the prior art automatic accompaniment line generation techniques, only insufficient considerations are paid to these points.

SUMMARY OF THE INVENTION

An object of the invention is to provide a system for automatically determining a principal tone for each of a plurality of segments of an accompaniment line by utilizing soph artificial intelligence.

Another object of the invention is to provide a system for automatically determining such principal tones based on knowledge of music which is wider and deeper than that utilized in the prior art.

Another object of the invention is to provide a system for automatically determining such principal tones by simulating a composer's or player's characteristic process of producing an accompaniment line to an extent to which the prior art has not accessed.

A further object of the invention is to provide a system for automatically generating such principal tones according to changing musical situations.

A still further object of the invention is to provide a system for automatically generating such principal tones so that the structural features of music will be reflected in the generated accompaniment line.

Another object of the invention is to provide a system for automatically determining such principal tones by monitoring a melody line.

A further object of the invention is to provide a system which extracts a main or conspicuous tone of a melody line and determines such principal tones in consideration of the extracted main melody tone.

According to the present invention, a system for determining a principal tone for each of a plurality of segments of an accompaniment line, in an environment wherein data of music are provided before said principal tone is determined, comprises hierarchic structure means for defining, as at least part of said data of music, a hierarchic structure of segments of music; and principal tone inference means for generating an output signal based on inferring a principal tone for segment of interest among said segments of music, in accordance with said hierarchic structure defined by said hierarchic structure means, whereby a principal tone is determined by said principal tone inference means for each of said plurality of segments of the accompaniment line.

According to a further aspect of the invention, the hierarchic structure means includes means for defining a past segment of music having the same hierarchic level as a segment of interest; and the said principal tone inference means includes means for inferring a principal tone of said segment of interest in a form dependent on a principal tone determined for said past segment having the same hierarchic level as said segment of interest.

When a piece of music includes segments each having the same hierarchic level as an immediately preceding segment, and other segments each having the same hierarchic level as a like segment in a like musical phrase, the principal tone inference means includes immediate dependent inference means for inferring, when a segment of interest has the same hierarchic level as the immediately preceding segment, a principal tone for said segment of interest by reference to a principal tone determined for said immediately preceding segment; and past phrase dependent inference means for inferring, when a segment of interest has the same hierarchic level as a like segment in a like musical phrase, a principal tone for said segment of interest to be tone related to the principal tone determined for said related segment in the past. Still further, when the first and last segments of a piece of music are assigned the highest hierarchic level, the principal tone inference means includes means for inferring, when a segment of interest is said first or last segment of said piece of music, a principal tone for said segment of interest to be a root.

According to yet another aspect of the invention, the hierarchic structure means includes musical form memory means for storing a type of each musical phrase and a first segment number of each musical phrase; and the principal tone inference means includes: segment matching means for reading out data of said musical form memory means and for checking as to whether a segment of interest is a first segment of a musical phrase of a certain type; and executing means for inferring, when it has been found by segment matching means that said segment of interest is said first segment of said musical phrase of a certain type, a tone related to a principal tone determined for a first segment of a past musical phrase of a related type to be a principal tone for said segment of interest.

BRIEF DESCRIPTION OF THE DRAWINGS

The above and other objects, features and advantage of the invention in connection with the accompanying drawings, in which:

FIG. 3 shows chord progression data;

FIG. 4 shows musical form data;

FIG. 6 is a list of main variables used in the first embodiment;

DETAILED DESCRIPTION OF PREFERRED EMBODIMENTS

Embodiments of the present invention will be described. A first embodiment is a system for determining or generating principal tones of a bass line on a non-real time basis, while a second embodiment is a system for generating bass line principal tones on a real time basis. In the first nonreal time embodiment, there are provided data of music, such as a melody line, a chord progression and a musical form, of a piece of music before principal tones are generated. In the second real time embodiment, there is no preset data of music, and, the root and type of chord are extracted from the key data real-time supplied from a music input device.

FIRST EMBODIMENT

Overall Arrangement

Figure 1:
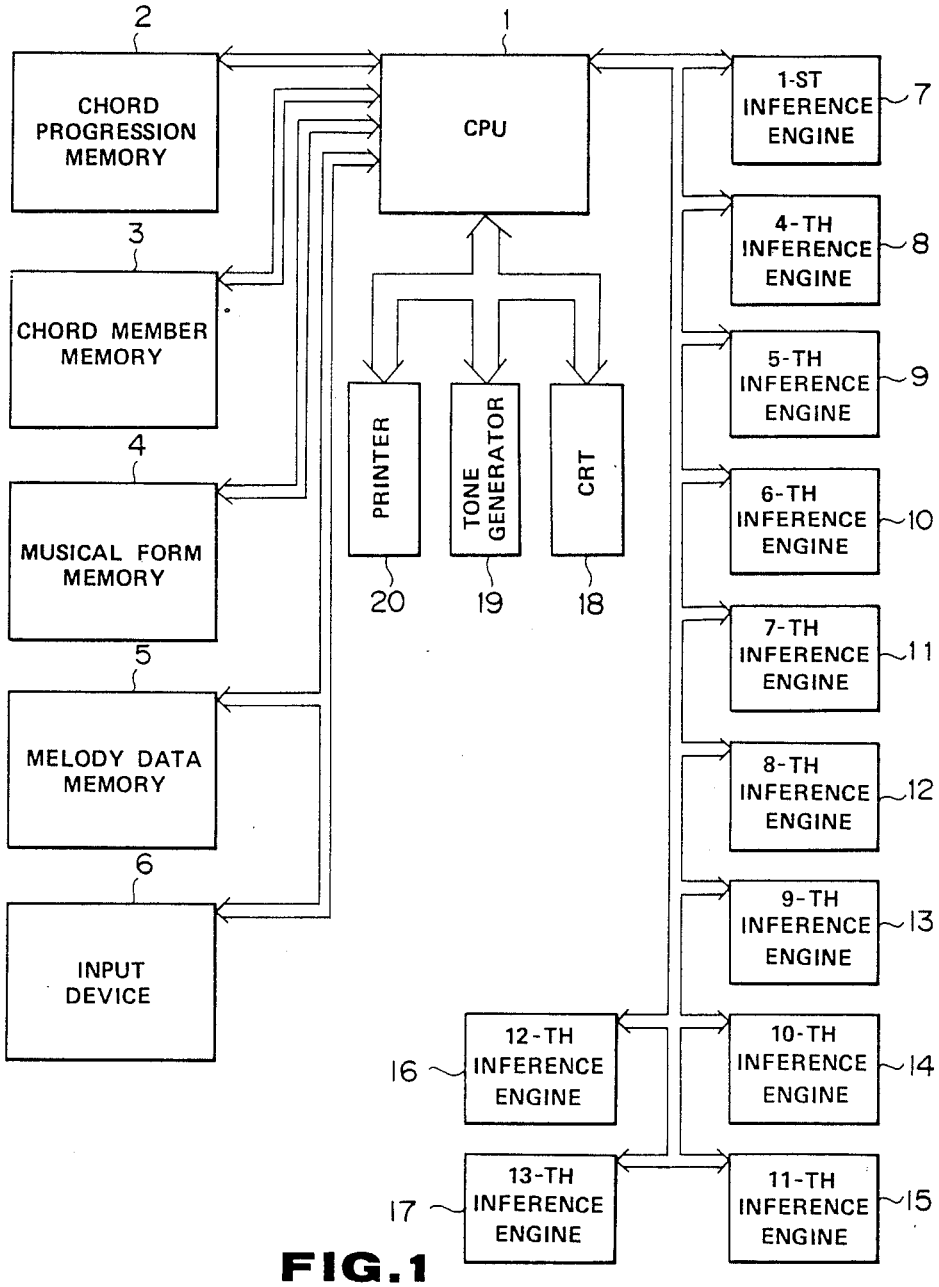
FIG. 1 is a block diagram of an accompaniment line principal tone determination system of non-real-time type in accordance with a first embodiment of the invention.

FIG. 1 shows the overall arrangement of the first embodiment of the invention, which is a system for determining accompanimental bass line principal tones on a non-real-time basis. As is shown, the system comprises a CPU 1, a chord progression memory 2, a chord member memory 3 a musical form memory 4, a melody data memory 5, an input device 6, inference engines 7 to 17 constituting various principal tone inference means, a CRT 18, a tone generator 19 and a printer 20.

In the melody data memory 5 is stored melody data which constitutes a memory line of a piece of music and is input from the input device 6.

In the musical form memory 4 is stored data concerning the form of the music. FIG. 4 shows an example of the musical form data. In this example, data in upper digit A1 represents the starting measure number of a phrase, and data in lower digit A2 represents the type of that phrase.

Figure 2A:
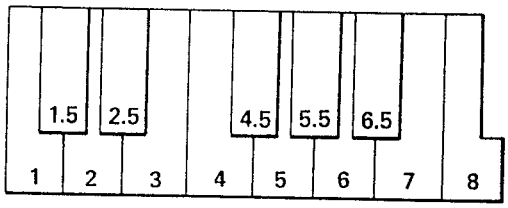
FIG. 2 shows examples of pitch data.
Figure 2B:
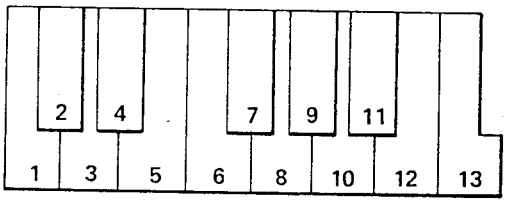

In the chord progression memory 2 is stored data concerning the chord progression of the musical piece, and in the chord member memory 3 is stored data concerning member notes of each chord. To express a note, pitch data and duration data are necessary. Pitch data represents a pitch. FIG. 2 shows examples of pitch data assigned to individual pitches on a scale. In example (b), the pitch data consists of integers incrementing by one for each semitone rise. In example (a), integers are assigned to white keys (diatonic scale notes consisting of do, re, mi, fa, sol, la and si) and non-integers to black keys. Other ways of assigning numbers to pitches are possible, and it is theoretically sufficient if a one-to-one correspondence between numbers and pitches is provided. An example of flow to be described later, however, deals with the example (b). In this case, one octave corresponds to "12". FIG. 3 shows an example of data concerning chord progression and chord members The data as shown are stored in the chord progression memory 2 and chord member memory 3.

The first to 13-th inference engines 7 to 17 constitute respective principal tone inference means having different inference logics. The CPU 1 controls the priority given to the inference functions of the inference engines 7 to 17. Basically, each principal tone inference means comprises a condition check section for checking whether a musical condition holds and an inferred principal tone generation section (or action section) for generating an inferred principal tone.

Briefly, the functions of the individual inference engines 7 to 17 are as follows.

first inference engine, 7: It infers the first principal tone in a piece of music to be root.

4-th inference engine, 8: It infers a chord member closest to the principal tone in the immediately preceding segment, i.e., adjacent tone, to be the principal tone for the segment of interest.

5-th inference engine, 9: It performs a check by using a provisional current principal tone (i.e., the output of the fourth inference engine, 8, here) as to whether there is a predetermined relation among the provisional current principal tone, current root and immediately preceding principal tone and, if there is such a relation (in other words, if the current root is sufficiently close to the immediately preceding principal tone), infers the current root to be a current principal tone.

6-th inference engine, 10: At a starting measure in a motif-repeating phrase, it infers the principal tone to be a root.

7-th inference engine, 11: If a chord progression of three consecutive segments remote from a starting measure in a phrase contains a bass progression (i.e., a chord tone series) satisfying a passing tone condition, it collectively generates the principal tones in these three segments with a passing tone connecting roots.

8-th inference engine, 12: This engine has no particular condition check section, and it extracts the main melody tone in melody line.

9-th inference engine, 13: If a segment of interest is a dominant chord (V) and the main melody tone of melody line is not a dominant, this engine infers the dominant to be a current principal tone. In this case, the dominant is a root.

10-th inference engine, 14: In a V-1 progression, the engine infers leading tone (si) and tonic (do) to be principal tones of the respective segment V and I.

11-th inference engine, 15: In a progression other than the V-I progression, if the provisional current principal tone is a leading tone, the engine infers a closest tone among the chord members other than the leading tone to the immediately preceding principal tone to be a principal tone.

12-th inference engine, 16: If the provisional current principal tone is the same (i.e., has the same pitch name) as the main melody tone of melody line, the engine infers the closest tone among the chord members other than that tone to the immediately preceding tone to be a principal tone.

13-th inference engine, 17: It infers the last principal tone in the piece of music to be a root.

Overall Routine

Figure 7:
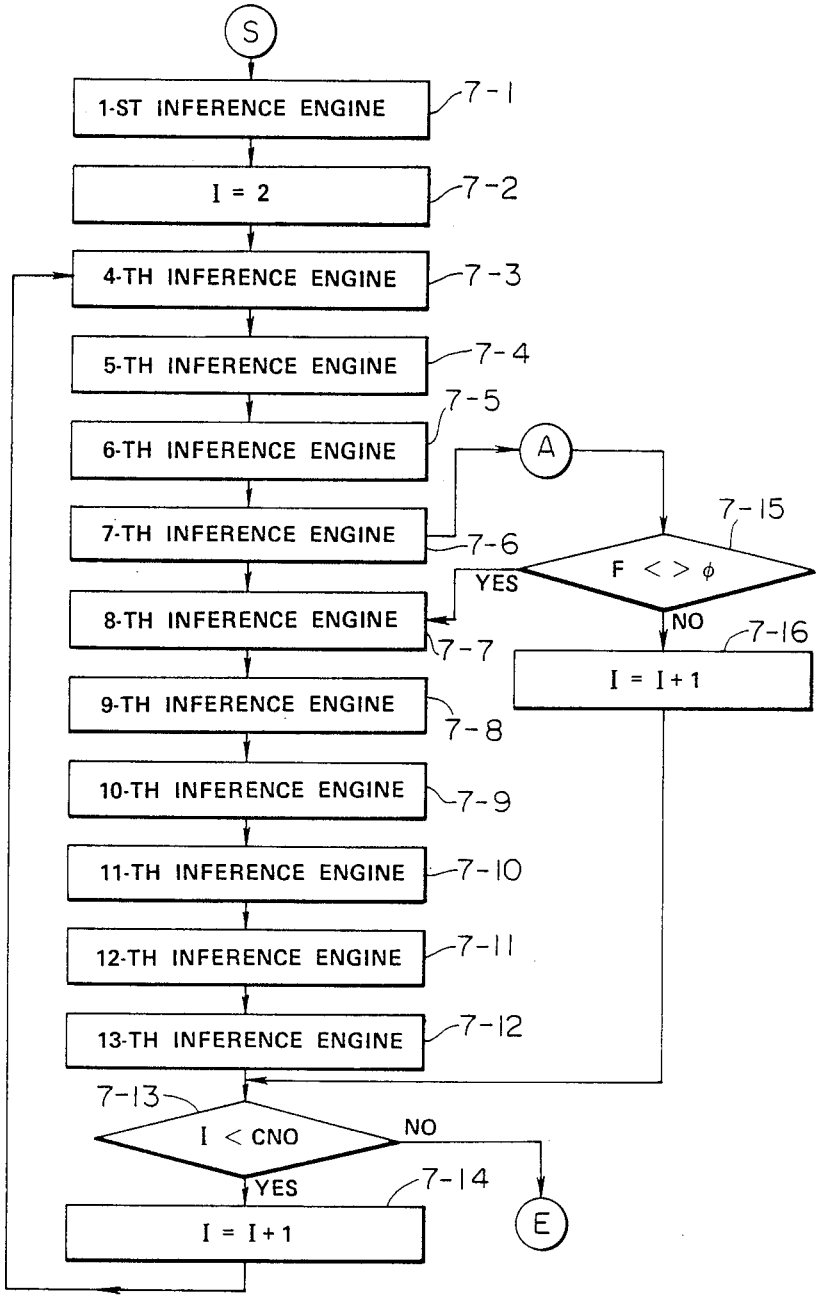
FIG. 7 is a flowchart showing the overall routine of the first embodiment.

FIG. 7 exemplifies an overall principal tone generation routine of the first embodiment, i.e., the non-real-time basis principal tone determination system. In this example, in each inference engine the principal tone generation section is rendered operative if it is confirmed by the condition check section that the associate condition is satisfied. Therefore, if it is not confirmed by the condition check section that any condition is satisfied, the principal tone generation section does not alter the provisional or assumed current principal tone. In this constitution, the fourth inference engine has to infer the current principal tone at all time. This inference means infers the closest chord member to the preceding principal tone to be a current principal tone.

FIG. 6 lists main variables used in the flow charts of FIGS. 8 to 20 for detailed explanation of the routines of the individual inference engines.

For the sake of simplicity, the pitch range of the melody line in the routine is assumed to be from a lowest pitch of $S=1$ to a highest pitch of $S=25$. Also, it is assumed that the principal tone is variable in a range of three octaves centered on the pitch of tone described in the chord member memory 3 (no definite upper limit of the range, however, being used). Further, a chord segment and a measure are assumed to be of the same duration. One principal tone is generated for each chord segment.

First Inference Engine

Figure 8:
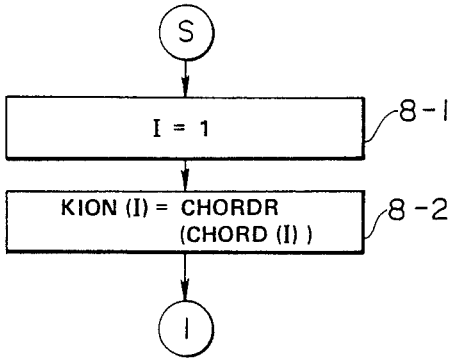
FIG. 8 is a flowchart showing the routine of a first inference engine.

FIG. 8 exemplifies the routine of the 1-st inference engine 7. In Step 8-1 of this flow, $I=1$ represents the start of music i.e., the first measure. In step 8-2, the engine infers the root of the first chord of this measure to be the principal tone of bass.

4-th Inference Engine

Figure 9:
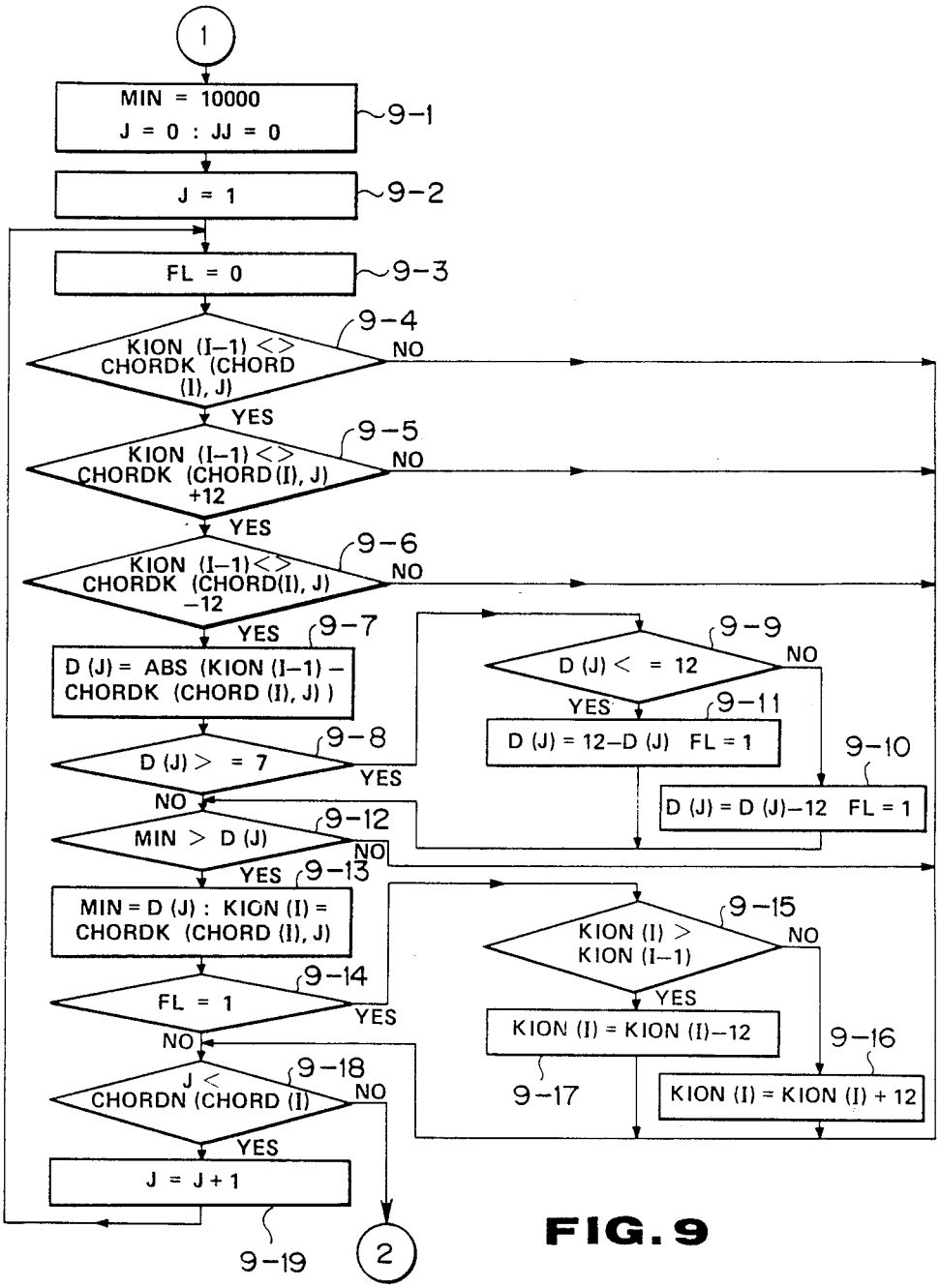
FIG. 9 is a flowchart showing the routine of a 4-th inference engine.

In step 7-2 of the overall routine (FIG. 7), the segment of interest is shifted to the second measure, and in the loop of steps 7-3 through 7-16, a principal tone of x-th ($x \geqq 2$) measure or principal tone of this measure and one or two succeeding measures are determined. The step 7-3, the first step in the loop, is executed by the 4-th inference engine 8. FIG. 9 exemplifies the routine 7-3 of the 4-th inference engine.

As stated, the function of this engine is to infer the closest chord member to the principal tone of the preceding measure (i.e., (I-1)-th measure) to be the principal tone of the measure of interest (i.e., I-th measure). J represents the chord member number, and MIN a variable or register of the closest chord member that is found. A flag FL is used in connection with comparison of absolute pitches made by the present system. It is possible compare pitch names instead of absolute pitches.

In steps 9-4 through 9-6 it is checked whether the J-th chord member is the same (in terms of pitch name or pitch in the octave) as the preceding principal tone. In other words, the pitch name KN (J) of the J-th chord member CHORDK (CHORD (I), J) of the I-th chord is given by $$KN(J)=(CHORDK(CHORD(I),J)\ MOD\ 12).$$

Likewise, the name KN (I-1) of the pitch KION (I-1) of the preceding principal tone is given by

KN (I-1)=(KION (I-1) MOD 12).

In steps 9-4 through 9-6 it is checked whether KN (I-1)≠KN (J), i.e., the immediately preceding principal tone and J-th chord member are different in the pitch name.

If they are the same in the pitch name, comparison between the next chord member and the preceding principal tone will follow.

If the two tones are different, the pitch difference between the preceding principal tone and J-th chord member is substituted for D (J) (step 9-7). Then, it is checked whether the pitch difference D (J) is greater than half of octave (step 9-8). If the result of the check is YES, it is further checked whether D (J) is greater than one octave. These two checks are done in order to evaluate or reduce the pitch difference to less than half of octave as is seen from the process of steps 9-10 and 9-11. Another purpose of the check is to set a flag FL for a one-octave change of a principal tone when a route via a step 9—9 is taken. Considering the pitch name difference U (J) in lieu of the pitch difference, where U (J) is Semitone≦U (J)≦Major 7-th, it will be seen that the final D (J) is given by D (J)=MIN (U (J), a complement of U (J) to one octave).

For example, in the case of do and sol, sol may be regarded to be either 5-th degree (here 7 in numeral) above do or 4-th degree (5 in numeral) below do. The latter is closer than the former.

In this way, D (J) evaluated less than half of octave is compared to the content of MIN in a step 9-12. A relation of MIN>D (J) holds when the J-th chord member is closest to the preceding principal tone among the checked chord members.

The purpose of the 4-th inference engine (routine 7-3) is to find out the closest current chord member to the preceding principal tone and to infer it to be the current principal tone. Thus, when MIN>D (J) is satisfied, MIN is updated by D (J), and the J-th chord member is set in the principal tone register KION (I) of the I-th segment (current segment), as seen in a step 9-13.

Steps 9-14 through 9-17 constitute a correction step corresponding to steps 9-8 through 9-11. More particularly, if it was found in a step 9-8 that D (J) is greater than a half of octave, an octave change of D (J) was effected (steps 9-10 and 9-11). Thus, by effecting conversion in steps 9-15 through 9-17, the current principal tone KION (I) is corrected to have an interval of less than half of octave from the immediately preceding tone (octave shift of data of a chord member pitch). If the original interval is smaller than half of octave (FL=0), no modification is required. As stated, it is possible to make pitch name comparison in lieu of the pitch comparison regarding the process prior to a step 9-14. In that case, a chord member higher than the preceding principal tone by greater than half of octave should be lowered by one octave to become closer to the preceding principal tone. To show this, an upper/-lower flag is set. In the process of octave control, if the upper/lower flag shows the upper side, the pitch difference or pitch name difference D (J) between the preceding and current principal tone is added to the pitch of the preceding principal tone to obtain the pitch of the current principal tone (KION (I)=KION (I-1)+D (J)). If the flag indicates the lower side, a subtraction

KION (I)=KION (I-1)−D (J)

is executed. This is substantially equivalent to the process of octave control in steps 9-14 through 9-17. Alternatively in an adjacent tone search, D (J) of a tone adjacent to and higher than the preceding principal tone may be set in MIN (upper) and D (J) of another tone adjacent to and lower than the preceding tone in MIN (lower). If it is found at the time of conversion to the pitch that the pitch resulting from adding MIN (upper) to the pitch of the preceding principal tone exceeds the upper limit, a tone of the pitch obtained by subtracting MIN (lower) from the pitch of the preceding principal tone may be inferred to be a current principal tone. If not exceeded, a tone obtained by shifting the preceding principal tone by the smaller one of MIN (upper) and MIN (lower) is inferred to be the current principal tone.

In a step 9-18 a check is done as to whether all the chord members have been read out and, if so, the next chord member is evaluated. When it is found in a step 9-18 that J=CHORDN (CHORD (I)), the closest chord member of the current segment to the preceding principal tone has been set KION (I). Thus, the inference by the 4-th inference engine is over.

5-th Inference Engine

Figure 10:
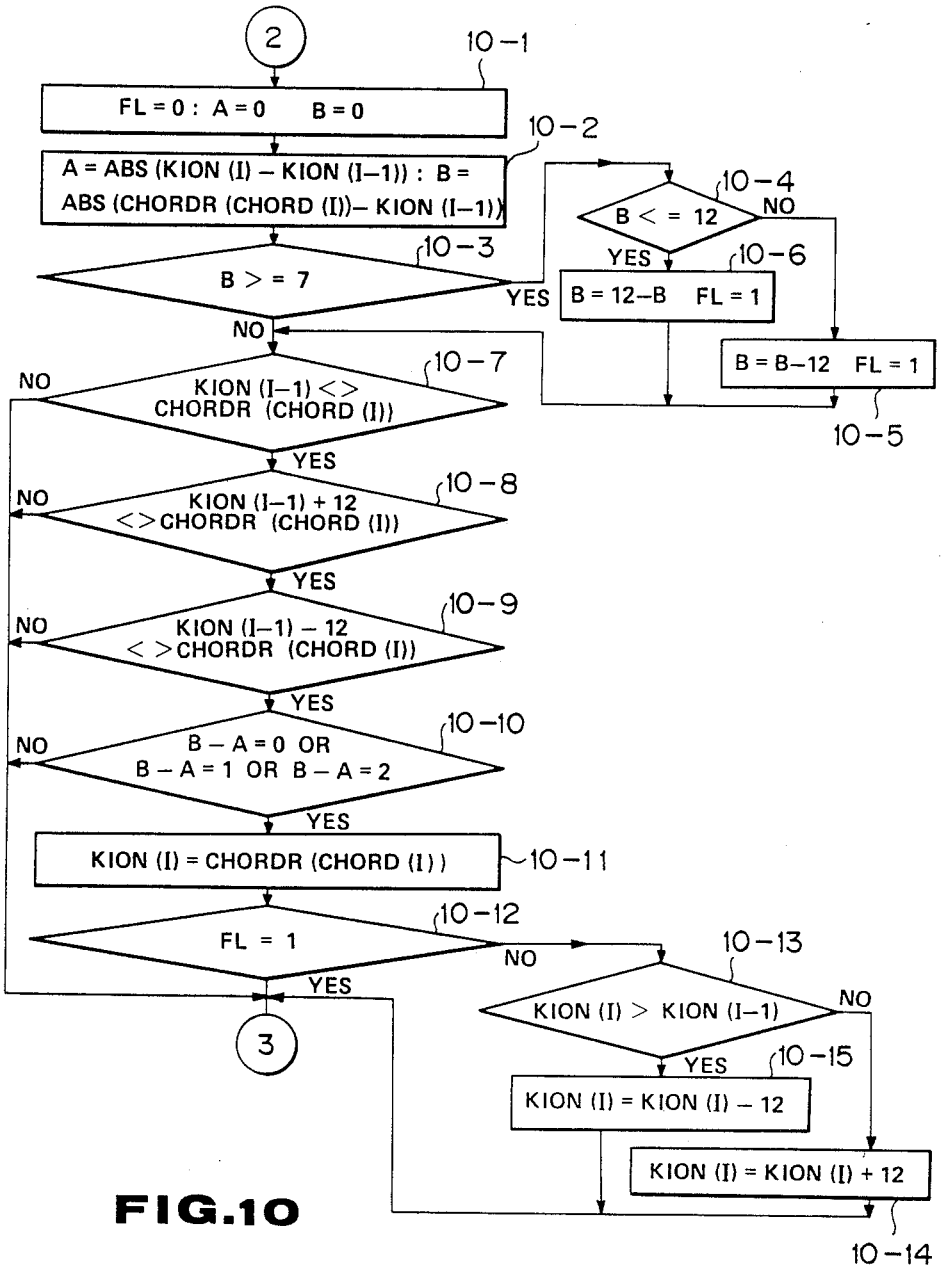
FIG. 10 is a flowchart showing the routine of a 5-th inference engine.

As shown in the overall routine, step 7-4 by the 5-th inference engine 9 is executed next to step 7-3 by the 4-th inference engine 8. FIG. 10 exemplifies the routine 7-4. The purpose of this engine is to perform a check by using the principal tone in the current segment of interest as given in the step 7-3 by the 4-th inference engine as an assumed or provisional principal tone as to whether there exists a particular relation among the provisional principal tone preceding principal tone and root of the chord in the segment of interest and, if the relation exists, infers the root in that segment to be a principal tone.

Steps 10-3 through 10-6 are similar to the steps 9-8 through 9-11 described before, and likewise steps 10-12 through 10-15 are similar to the steps 9-14 through 9-17. Therefore, these steps are not described in detail. In step 10-2, the pitch difference between the preceding and current principal tones is set in register A, and the difference between the preceding principal tone and current chord root is set in register B. KION (I) represents an output produced in the step 7-3 by the 4-th inference engine, and this means that the CPU 1 which serves as priority control means provides the principal tone as inferred in the step 7-3 by the 4-th inference engine for the step 7-4 by the 5-th inference engine. The steps following step 10—10 are executed by the action section or principal tone generation section of the 5-th inference engine, and preceding steps are executed by the condition check section.

That is, the steps 10—7 through 10—10 are in charge of the condition check section of the 5-th inference engine. This section checks the following conditions.

(A) Whether the preceding and current principal tones are of different pitch names; and (B) Whether the difference between the pitch name difference A (i.e. between the preceding principal tone and current provisional principal tone) and the pitch name difference A (i.e. between the preceding principal tone and current root) is equal to or less than a whole tone (briefly whether the current root is sufficiently close to the preceding principal tone).

If these two condition (A) and (B) are recognized, the condition check section yields YES as a result of check. Otherwise, it yields NO.

If YES is yielded, the current root is issued as current principal tone. If the result of check is NO, the principal tone as inferred by the 4-th inference engine is passed to the next engine without any modification.

It is to be understood that the 5-th inference engine 9 re-checks the principal tone inferred in the step 7-3 by the 4-th inference engine and selectively changes the principal tone to the root if certain conditions are met. In other words, the 5-th inference engine performs in co-operation with the priority control means a function as correction means for correcting the output provided by the 4-th inference engine.

6-th Inference Engine

Figure 11:
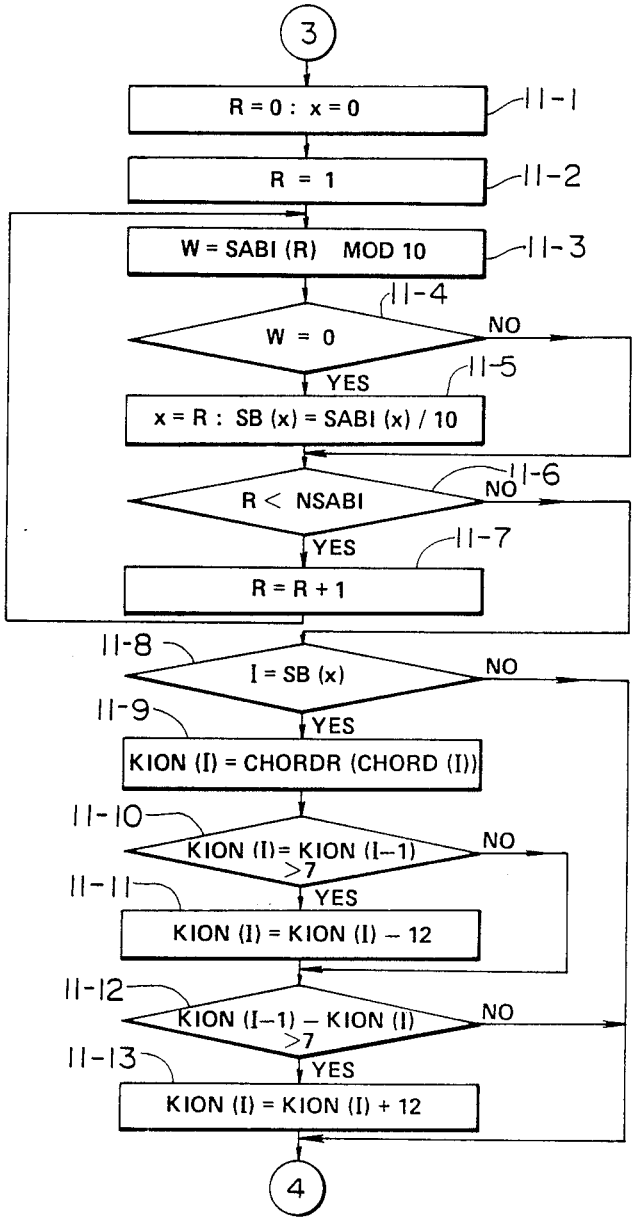
FIG. 11 is a flowchart showing the routine of a 6-th inference engine.

FIG. 11 exemplifies routine 7-5 performed by the 6-th inference engine 10. The role of the 6-th inference engine in the entire principal tone determination system is to infer the principal tone for the first measure in a phrase repeating the motif (i.e., the first phrase) to be a root. Steps 11-1 through 11-8 are executed by the condition check section, and step 11-9 and following steps are executed by the principal tone generation section.

In the steps 11-3 through 11-7, the number of the first measure of a repeat phrase (represented by the upper diqit of SABI (R)) is set in an array SB (x). Whether the phrase of interest is of repetitive type W (W=0) is known from MOD 10 of R-th phrase data SABI (R).

In step 11-9, it is checked whether there is a first measure number of a repeat phrase that coincides with the current measure number. If there is no such number, the condition check section of the 6-th inference engine yields NO, and the output either provided in the step 7-3 by the 4-th inference engine or modified in the step 7-4 by the 5-th inference engine is still effective. If a coincident first measure number is detected, the current measure is the first measure of a repeat phrase. In this case, the inferred principal tone generation section of the 6-th inference engine is rendered operative to execute steps 11-9 through 11-13, in which the current principal tone is inferred to be a root. The steps 11-10 through 11-13 constitute an octave adjustment process, in which the pitch of the current principal tone is made to be an interval smaller than half of octave from that of the preceding principal tone.

It is to be understood that the 6-th inference engine 10 checks whether there is a musical condition related to the structure of the piece of music and, if the check yields YES, the current principal tone is inferred to be the root. In other words, this engine has logic according to which the principal tone in the current segment is dependent on the principal tone in a segment which is earlier than the immediately preceding segment. This logic is like that of the first inference engine 7 in that it depends on the structure of or position in music.

7-th Inference Engine

Figure 12:
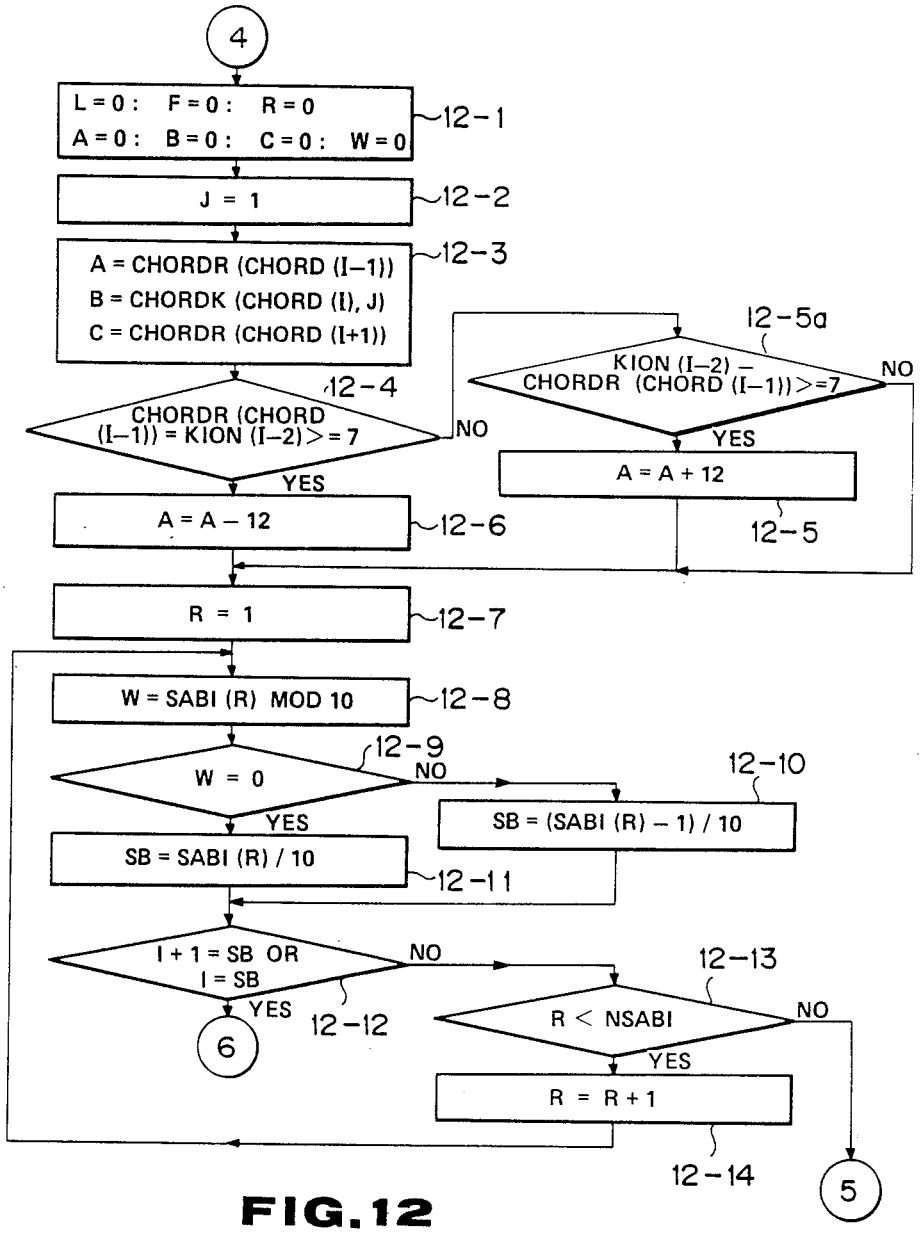
FIG. 12 is a flowchart showing a first half of the routine of a 7-th inference engine.
Figure 13A:
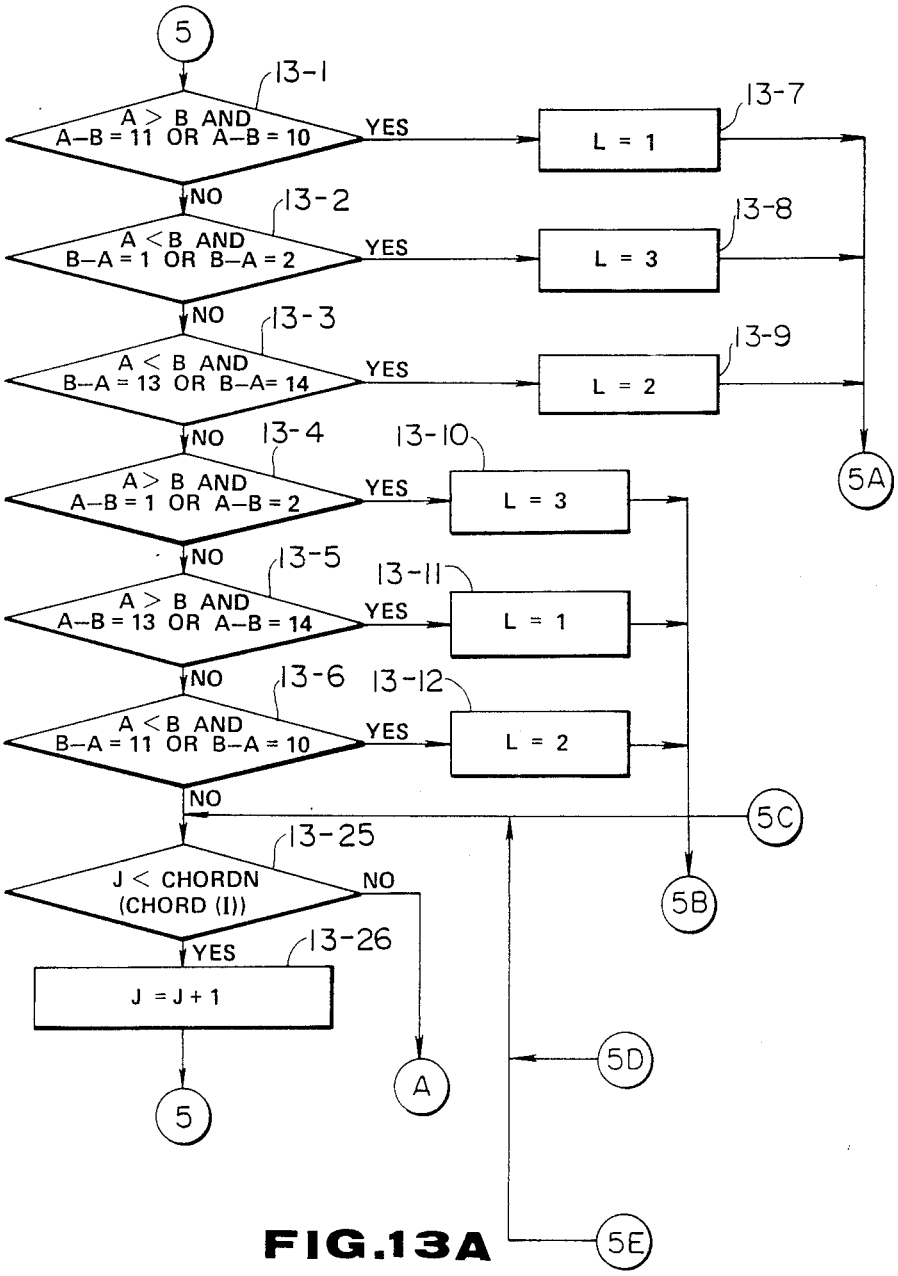
FIGS. 13A and 13B are a flowchart showing a second half of the routine of the 7-th inference engine.
Figure 13B:
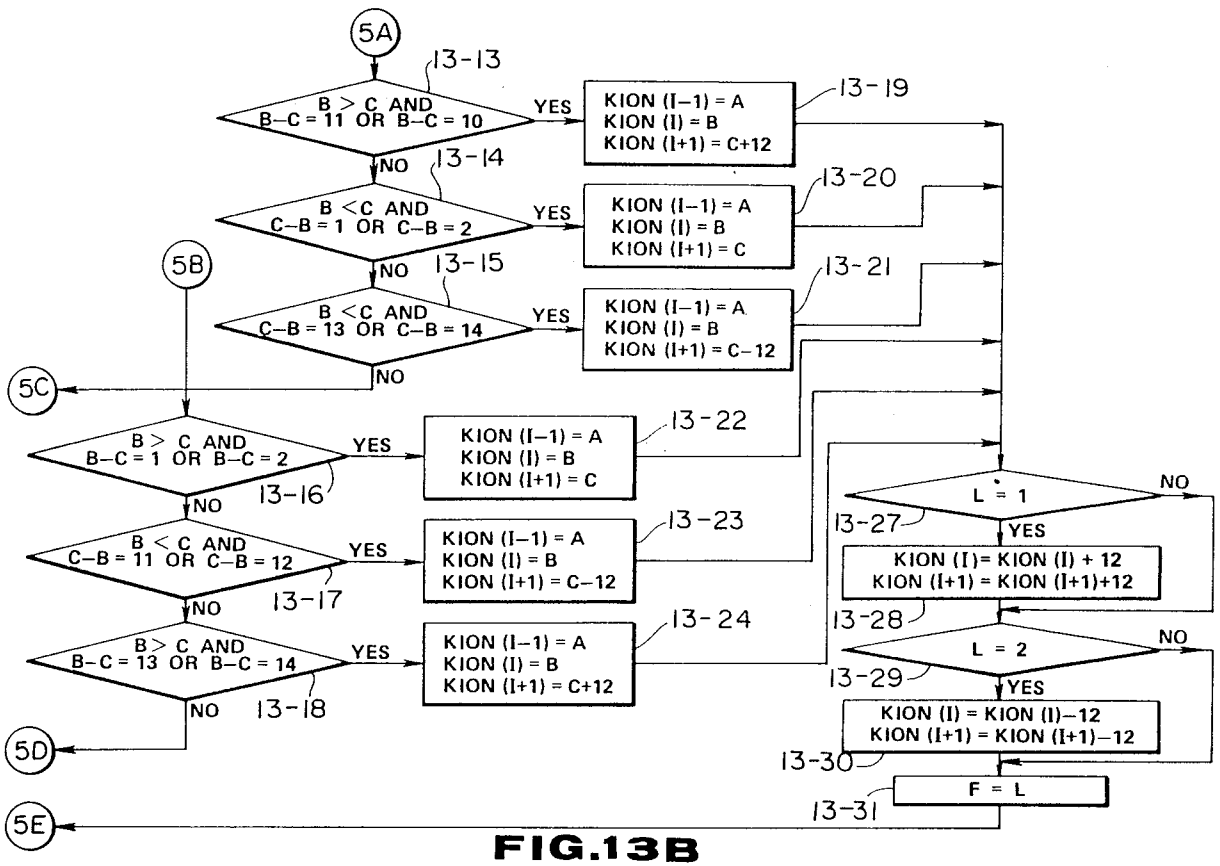

FIGS. 12, 13A and 13B exemplify the routine 7-6 performed by the 7-th inference engine 11. This routine 7-6 includes a first condition check routine (FIG. 12) to check whether the segment of interest has a predetermined relation to the starting position of the phrase concerned, a second condition check routine (FIG. 13A) executed if no particular relation is found in the first condition check routine to check whether there is a series of chord notes containing a root, then a passing tone and then a root, in three consecutive time intervals of chord I-1, I and I+1 (i.e., three consecutive measures in this example) and a principal tone generation routine (FIG. 13B) executed if such series is found to infer the pertinent root, passing tone and root to be the principal tones of the respective segment I-1, I and I+1.

If the first condition check subroutine yields NO, the system goes to routine 7—7 executed by the 8-th inference engine. If the second condition check routine yields NO (i.e., if no pertinent chord note series or train is found), the routine 7—7 is also executed. If the second condition check routine yields YES, a step 7-15 (FIG. 7) is executed to find F≠0. Then the segment I is incremented by 2 (see steps 7-16 and 7-14), and a principal tone determination process for segment I+2 will follow. In this case, the principal tones of the respective three segments I-1, I, and I+2 are finally determined.

More specifically, in steps 12-1 through 12-14 of FIG. 12, it is checked whether the segment I-1 of interest or the next segment I is the first measure of a phrase. In this example, if the segment of interest or the next segment is the first measure of a phrase, it is determined to be unsuitable to use a passing tone bass, and the principal tone already inferred on or before the routine 7-5 by the 6-th inference engine is made effective for the routine 7—7 by the 8-th inference engine. In other words, it is a necessary condition for the use of passing tone bass that the segment of interest or the next segment is not the first measure a phrase.

In step 12-3, the chord root of the segment I-1 is set in A register, the first chord member of the segment I is set in B, and the chord root of the segment I+1 is set in C. In steps 12-4 through 12-6, octave adjustment of the root A of the segment I-1 is done for coupling the pitch of the root to that of the determined principal tone of the segment I-2 within half of octave. The process of steps 12-2 through 12-6 may be performed right before the routine shown in FIG. 13. In steps 12-7 through 12-14, it is checked whether the segment I or the next segment I+1 is the first measure of a phrase. In steps 12-8 through 12-11, the first measure of the R-th phrase stored in the musical form memory 4 (FIG. 1) is decoded, and the result is set in SB. Whether the check has been done for all the phrases is checked in step 12-13 If it is found in step 12—12 that the first measure SB of the phrase of interest coincides with the segment I or I+1 the system goes to the routine 7—7 by the 8-th inference engine. If it is found that the segment I or the next segment I+1 does not coincide with any first measure of any phrase, the system goes to the routine shown in FIGS. 13A and 13B.

In the routine of FIG. 13A and 13B, a search for a series consisting of a root, then a passing tone and then a root in the three consecutive segments I-1, I and I+1 is done by exhaustively applying all the chord members If such a series is found, the series is inferred to be a succession of principal tones in the segments I-1, I and I+1. If no series satisfying the passing tone condition is found, the routine is over without alteration of any principal tone. More specifically, in steps 13-1 through 13-3, a check is done as to whether the J-th chord number of the segment I of interest is in an ascending stepwise (either semitone or whole tone) motion from the root of the segment I-1 In this example the routine is based on pitch comparison in the range of three octaves, so that three different comparisons are done alternatively. L=1 in Step 13-7 shows that when the chord tone of the segment I is raised by one octave, the resultant tone is in a pitch relation within half of octave with respect to the octave-adjusted root of the segment I-1. L =3 in step 13-8 indicates that no octave shift is necessary. L=2 in step 13-9 shows that the chord tone of the segment I has to be lowered by one octave. In steps 13-4 through 13-6, a check is done as to whether the J-th chord member in the segment I is in a descending stepwise motion from the root of the segment I-1. The contents of steps 13-10 through 13-12 are similar to those of the steps 13-7 through 13-9. If the motion from the segment I-1 to the segment I is an ascending step, a check is done in steps 13-13 through 13-15 as to whether the motion from the segment I to the segment I+1 is an ascending step. If the checked motion is an ascending one, the J-th chord member of the segment I is a passing tone in the ascending motion, and this result is issued in steps 13-19 through 13-21. Likewise, if the motion from the segment I-1 to the segment I is a descending step, a check is done in steps 13-16 through 13-18 as to whether the motion from the segment I to the segment I+1 is of the same slope polarity, i.e., a descending step. If the result of the check is YES, the J-th chord member of the segment I is a passing tone in a descending motion( and this result is issued in steps 13-22 through 13-24. Here again, not pitch names but pitches are compared. Therefore, for the pitch adjustment the tones in the segment I and I+1 are intercoupled within half of octave in steps 13-19 through 13-24. The octave adjustment process for the segment I-1 with respect to the determined segment I-2 has been performed n steps 12-4 through 12-6, and the octave adjustment process for the segment I+1 with respect to the segment I has been done in steps 13-19 through 13-24. A remaining process is the octave adjustment for the segments I and I+1 with respect to the segment I-1. This process is executed in steps 13-27 through 13-30. In a step 13-31, L is set in F to proceed to routine (A) (i.e., check of flag F is in a step 7-15).

If the J-th chord member in the segment I fails to satisfy the passing tone condition, J is incremented in step 13-26, and then a check is done as to whether the next chord member is a passing tone. If none of the chord members is a passing tone, it is found in a step 13-25 that J=CHORDN (CHORD (J)) with F=0 (see step 12-1), so that the process goes to the step 7-15 of checking the flag F in the overall routine.

In the routine shown in FIG. 13A and 13B, all the chord members are checked. Instead, it is possible to use a conversion table. More specifically, a progression of three particular chords includes a particular chord note series consisting of a root, then a passing tone and then a root. Hence, a search over three chord columns in the conversion table is performed using as keys the chords of the three segments of interest. Each of the three chord columns is linked to a conclusive section storing data of the particular progression consisting of a root, then a passing tone and a root. If three chords coincident with the keys are found as a result of the search, the linked conclusive section is read out, and the readout data are set in principal tone variables KION (I-1), KION (I) and KION (I+1) of the three segments I-1, I and I+1.

The routine example of FIGS. 12 and 13 is based on pitch comparison. Alternatively, it is possible to perform pitch name comparison to determine principal tones in the three consecutive segments according to pitch names and to add an octave name to the pitch name in each of the segments. (The octave number can be determined from the pitch in the segment I-2).

It is to be understood that if there is a certain condition concerning the structure of music, the 7-th inference engine 11 checks whether there is a progression of a root, then a passing tone and then a root in three consecutive segments and, if there is such a progression, issues these tones as a principal tone series. As is seen from the overall routine, such a principal tone series constitutes a determined principal tone series. If the condition noted above is not met, the principal tone for the segment I inferred by the engine upstream of the 7-th inference engine is still effective and passes to the downstream positioned engine. The role of the 7-th inference engine 11 in the system is to provide a character depending on the past and a character of a passing tone bass line to a bass line principal tone series.

8th Inference Engine

Figure 5:
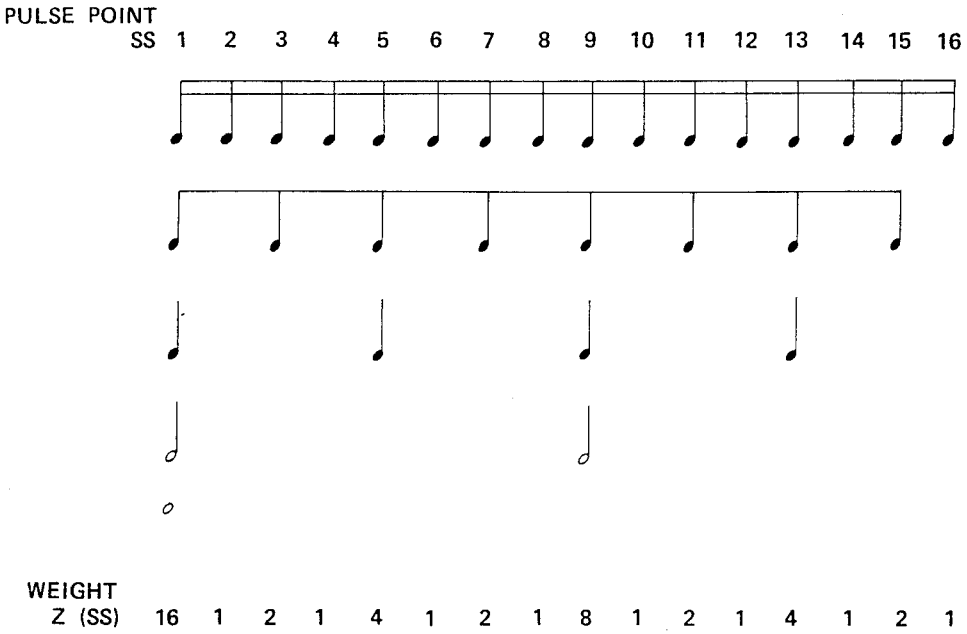
FIG. 5 shows an example of pulse scale.
Figure 14:
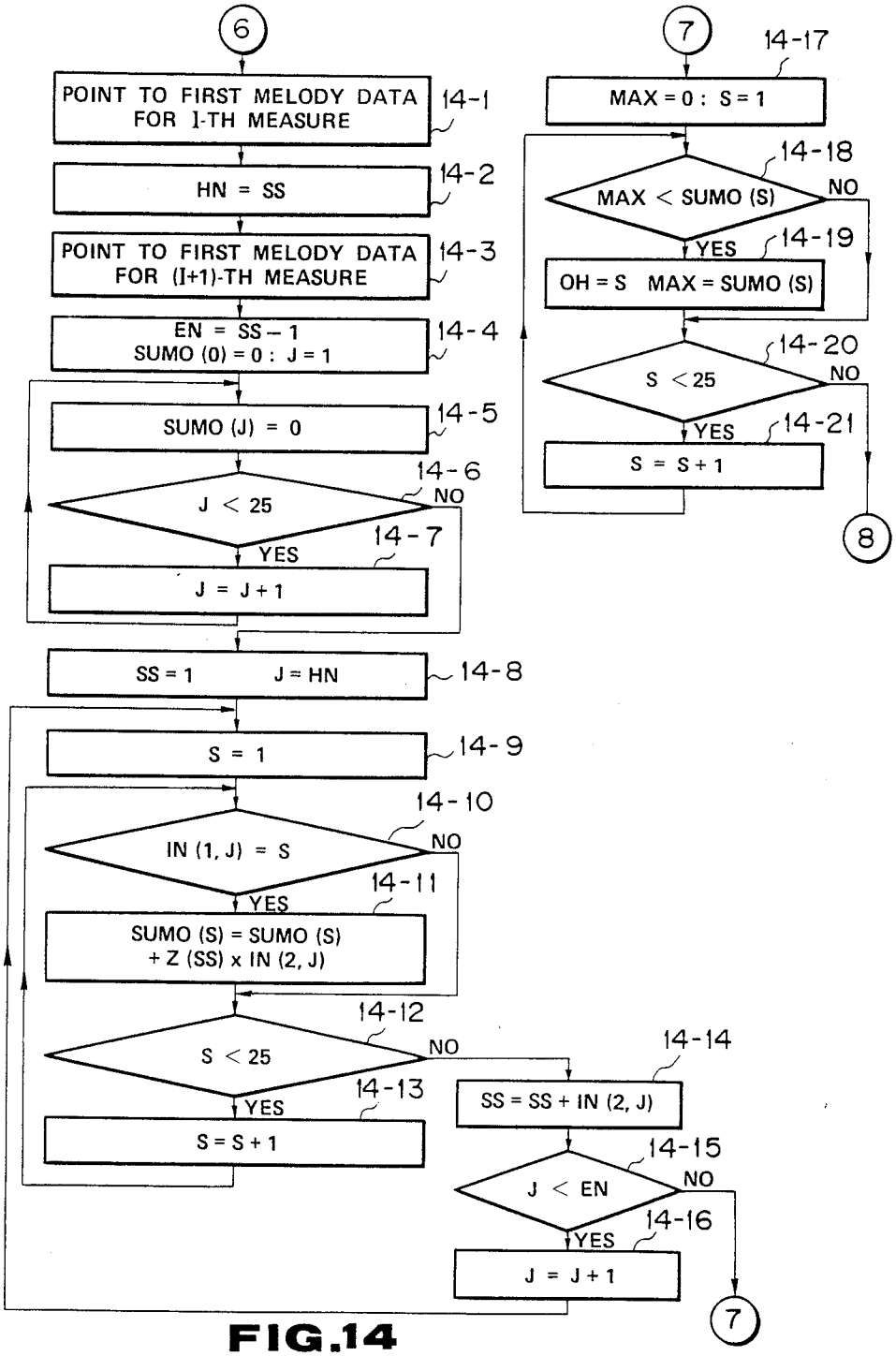
FIG. 14 is a flowchart showing the routine of an 8th inference engine.

The 8th inference engine 12 has no principal tone inference logic. The purpose of this engine is to extract a main melody tone in a segment of interest. This process, therefore, may be performed totally independently. For the sake of convenience, however, the routine 7—7 by the 8-th inference engine 12 is executed subsequent to the routine 7-6 by the 7-th inference engine 11. FIG. 14 shows in detail the routine 7—7 executed by the 8-th inference engine. The definition of the main melody tone in this routine is as follows. The main melody tone is a tone having a pitch among the pitches in the melody line in the segment of interest that maximizes a function of the position in the segment (i.e. measure in this example) and duration as variables. The function SUMO (S) is given by $$\text{SUMO (S)} = \Sigma Z\ (SS) \times IN\ (2, J)$$

wherein, SS represents the position in the segment, Z (SS) the weight of the position (see FIG. 5), IN the duration of the tone having the pitch S, and J the melody note number.

The definition of the main melody tone is only an example, and it is possible as well to evaluate a tone in terms of the pitch name in lieu of the pitch. The extraction of the main melody tone is done in order to take the main melody tone into consideration in the principal tone inference as will be described later.

Referring to FIG. 14, HN represents the number of the first melody tone in the segment of interest, and EN the number of the last melody tone in the segment of interest. These data are obtained by accessing the melody data memory 5. The melody tone range is assumed to be two octaves from S =1 to S=25. An evaluated value of each pitch is placed in an array of function (SUMO (S)). Steps 14-5 through 14-7 constitute an initialization process for the array (SUMO (S)). In steps 14-9 through 14-13 the pitch of J-th melody tone is obtained by scanning S, and the product of the weight and duration of that tone is accumulated in SUMO (S). In a step 14-16, J is incremented to proceed to the evaluation of SUMO (S) of the next melody tone. When it is found in a step 14-15 that J=EN, the evaluation value SUMO (S) is obtained with respect to each pitch S.

In steps 14-17 through 14-21, the maximum evaluation function value is obtained, and the pertinent S in inferred to be the main melody tone OH.

9-th Inference Engine

Figure 15:
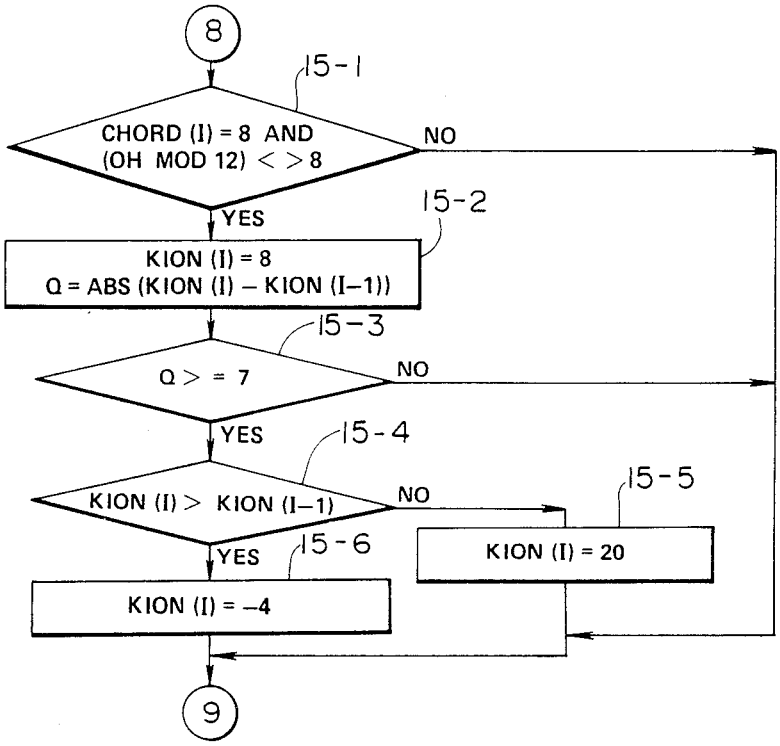
FIG. 15 is a flowchart showing the routine of a 9-th inference engine.

The purpose of the 9-th inference engine 13 is to make an inference when the chord of the segment of interest is a dominant chord or that the principal tone of the segment of interest is a root (dominant). In this example, it is an additional condition that the main melody tone of the segment of interest is not a dominant. FIG. 15 shows in detail the routine 7-8 executed by the 9-th inference engine.

A step 15-1 is a check step executed by the condition check section of the 9-th inference engine. A step 15-2 and following steps are executed by the inferred principal tone generation section of the 9-th inference engine.

A step 15-1 is a check step executed by the condition check section of the 9-th inference engine. A step 15-2 and following steps are executed by the inferred principal tone generation section of the 9th-inference engine. If the result of the check in the step 15-1 is NO, the principal tone inferred by the upstream positioned engine is still effective. If the result of the check is YES, i.e., if the chord CHORD (I) of the segment I of interest is a dominant (=8) and the main melody tone OH of this segment I is not a dominant, the principal tone of the segment of interest is issued as a dominant in the steps 15-2 through 15-6. The steps 15-3 through 15-6 constitute an octave adjustment process.

It is to be understood that the 9-th inference engine has a root-inferring logic and also a perfect 8-th inhibition rule.

10-th Inference Engine

Figure 16:
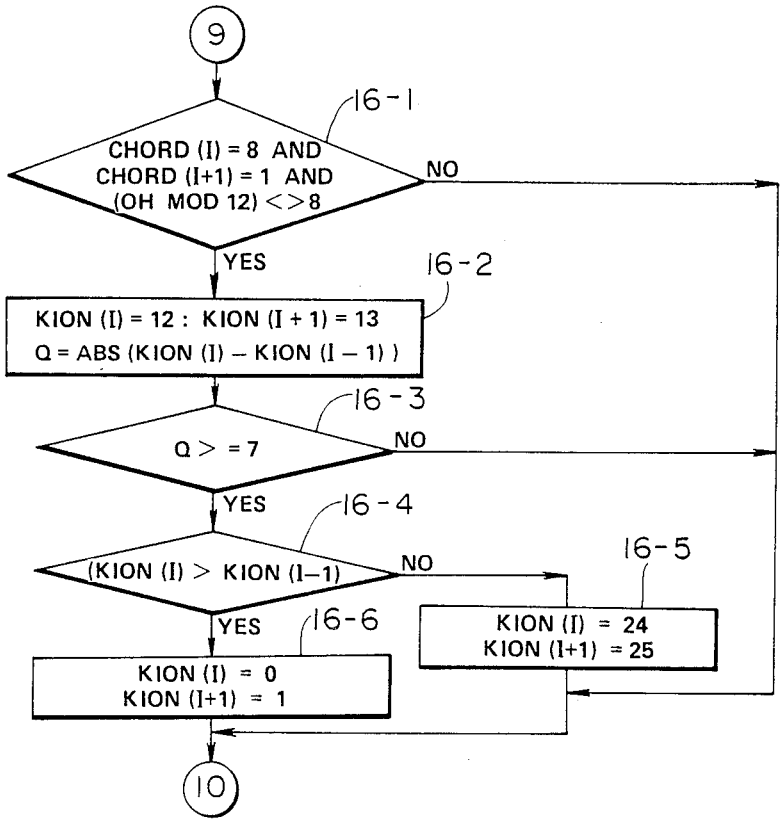
FIG. 16 is a flowchart showing the routine of a 10-th inference engine.

Subsequent to the routine 7-8 by the 9-th inference engine 13, the routine 7-9 by the 10-th inference engine 14 is executed (FIG. 7). The function of the 10-th inference engine is to make an inference in the case of V-I (dominant-tonic) chord progression that a VII (leading tone) - I (tonic) tone series is a principal tone series. The perfect 8-th inhibition rule is also adopted as an addition condition. FIG. 16 shows the details of the routine 7-9 by the 10-th inference engine.

A step 16-1 is a check step executed by the condition check section of the 10-th inference engine. Steps 16-2 through 16-6 are executed by the inferred principal tone generation section of the 10-th inference engine. This routine is very similar to the routine shown in FIG. 15, so that further description of the routine shown in FIG. 16 is omitted.

The 10-th inference engine is similar to the 7-th inference engine in that principal tones in a plurality of (i.e., two in this example) segments are collectively inferred. It is further similar to the 1st, 5-th and 6-th inference engines in that a root is inferred.

11-th Inference Engine

The 11-th inference engine 15 inhibits in the case of a chord progression other than a V-I progression the use of VII-th tone as principal tone, and it infers that the closest chord member to the preceding principal tone other than VII-th tone is a current principal tone. The condition check section of the 11-th inference engine uses a provisional current principal tone. The provisional current principal tone, as is seen from the routine shown in FIG. 7, is a current principal tone which is effective in the inference engines upstream of the 11-th inference engine. The condition check section issues YES if a chord progression of two consecutive segments I and I+1 is not a V-I progression and the provisional current principal tone of the segment I is a VII-th (leading tone). The inferred principal tone generation section of the 11-th inference engine has a logic of inferring the closest tone among the chord members other than the leading tone to be the current principal tone. Therefore, the generation section is similar to the 4-th inference engine 8 (closest tone inference means).

Figure 17A:
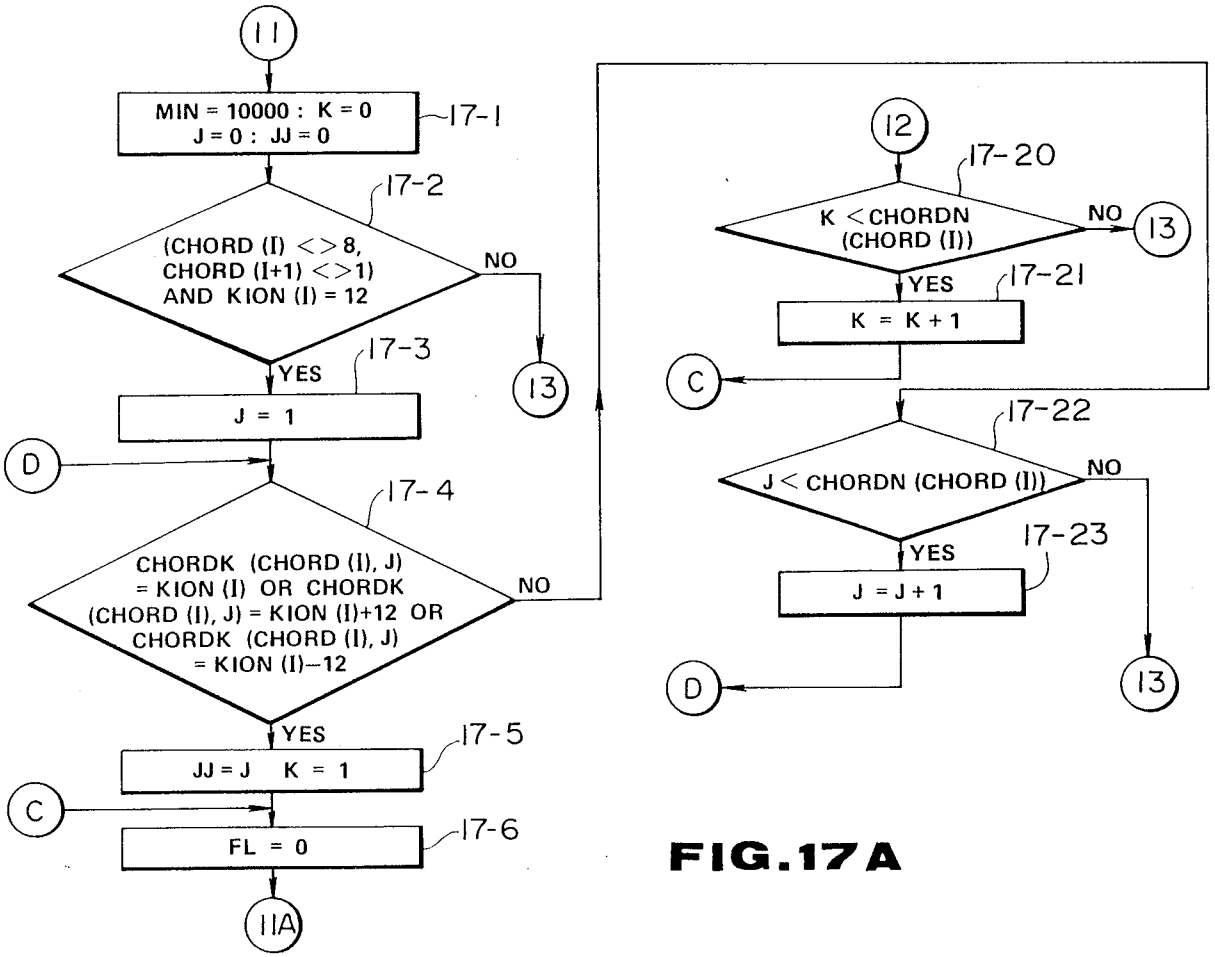
FIG. 17A and 17B are a flowchart showing the routine of an 11-th inference engine.
Figure 17B:
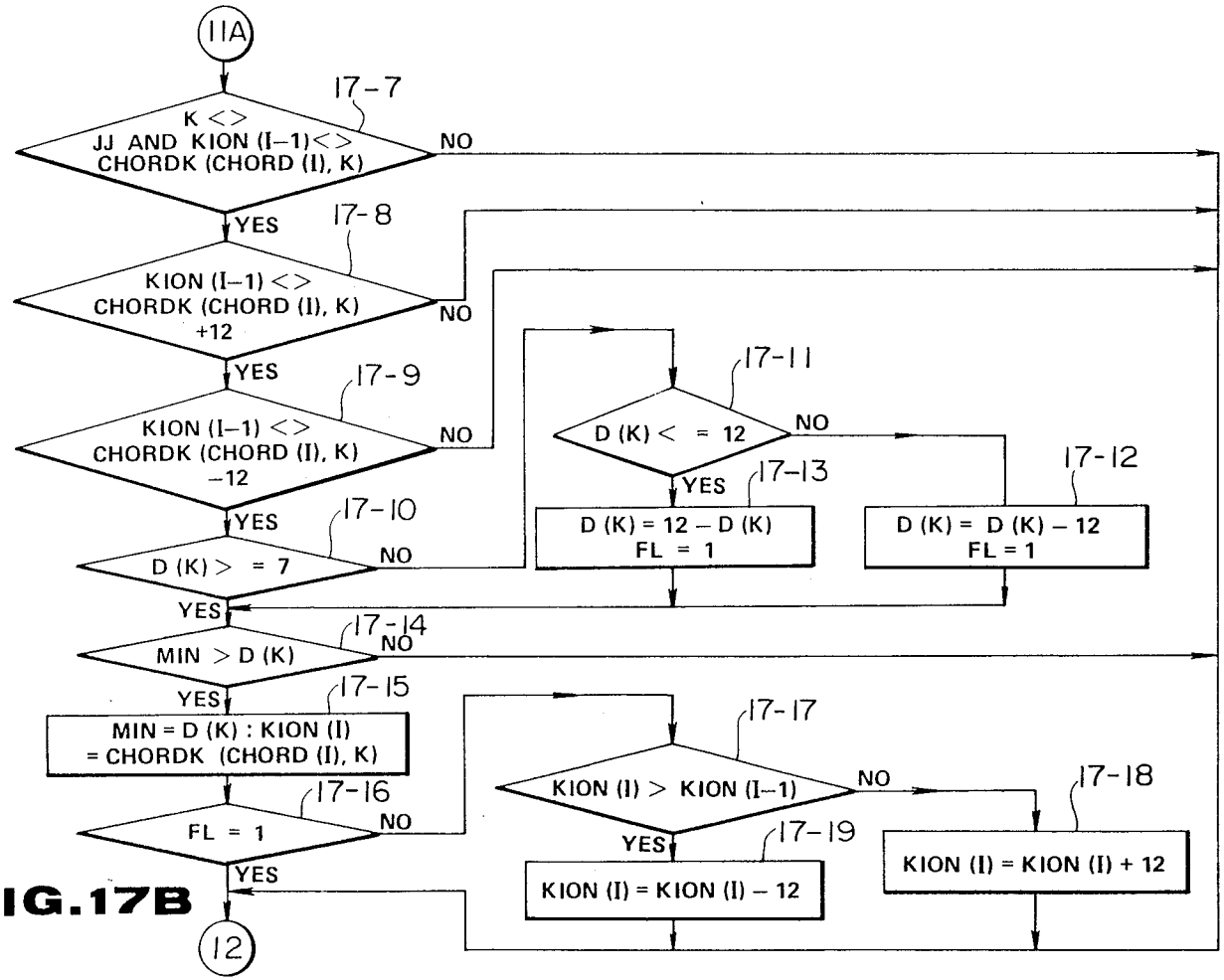

FIG. 17A and 17B exemplifies the routine 7-10 executed by the 11-th inference engine. A step 17-2 is a condition check executed by the condition check section. If the check section issues NO, the principal tone inferred by the inference engine upstream of this inference engine is still effective. If YES is issued, a step 17-3 and the following steps are executed by the inferred principal tone generation section. In this case, one of the chord members should coincide with the provisional current principal tone (VII-th tone). This chord member is stored in a step 17-5 subsequent to a check step 17-4. Steps 17-7 through 17-9 constitute a process for permitting a closest tone search in a step 17-10 and the following steps only with respect to the other chord members than the one noted above. D (K) in the step 17-10 stores the pitch difference between the preceding principal tone KION (I-1) and K-th chord member of interest. Steps 17-10 through 17-20 are similar to the steps 9-7 through 9-19 in the closest tone rule routine executed by the 4-th inference engine (FIG. 9). If the check in a step 17-20 yields NO, KION (I) stores the closest pitch to that of the preceding principal tone among the chord members other than the leading tone.

12-th Inference Engine

Figure 18A:
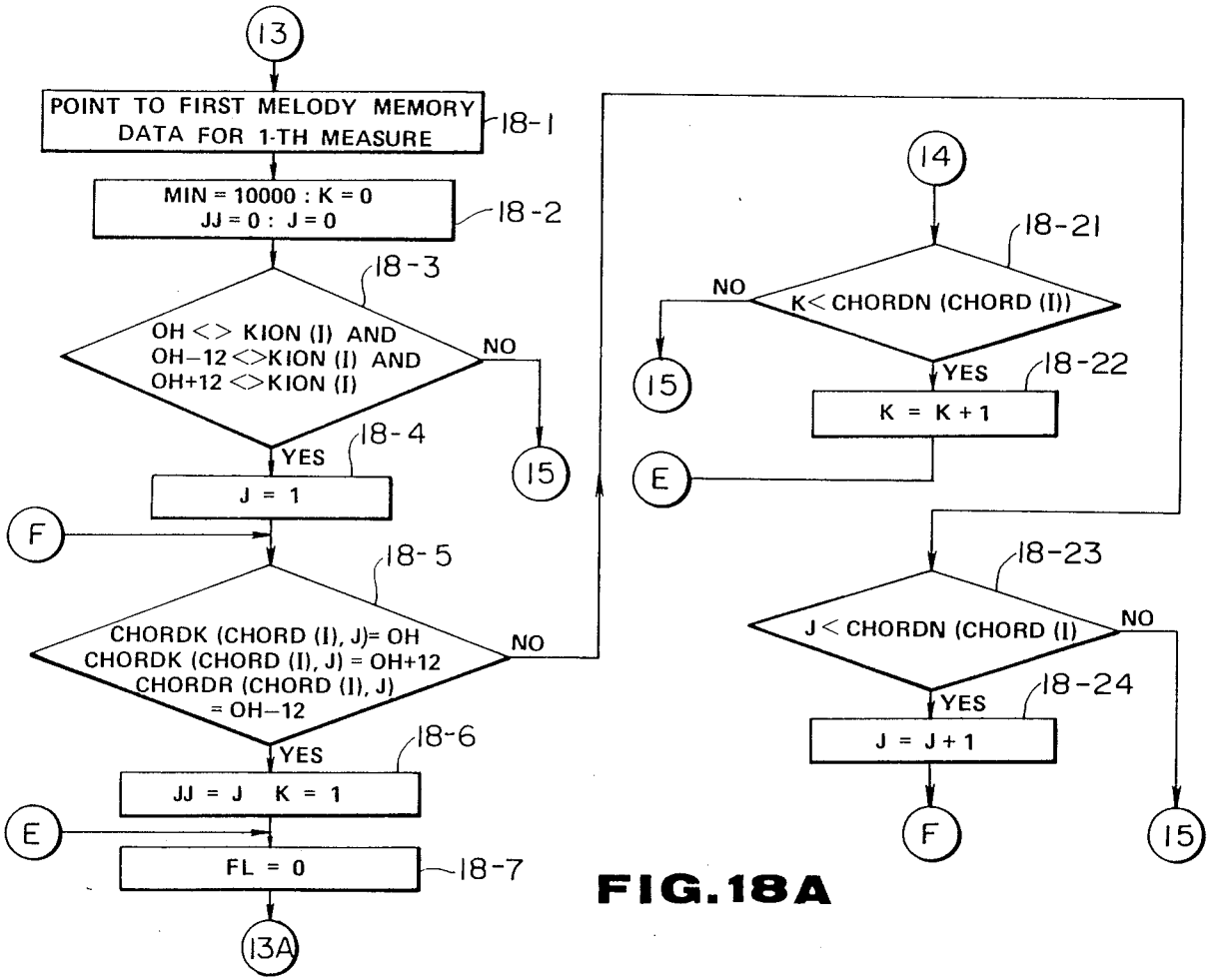
FIG. 18A and 18B are a flowchart showing the routine of a 12-th inference engine.
Figure 18B:
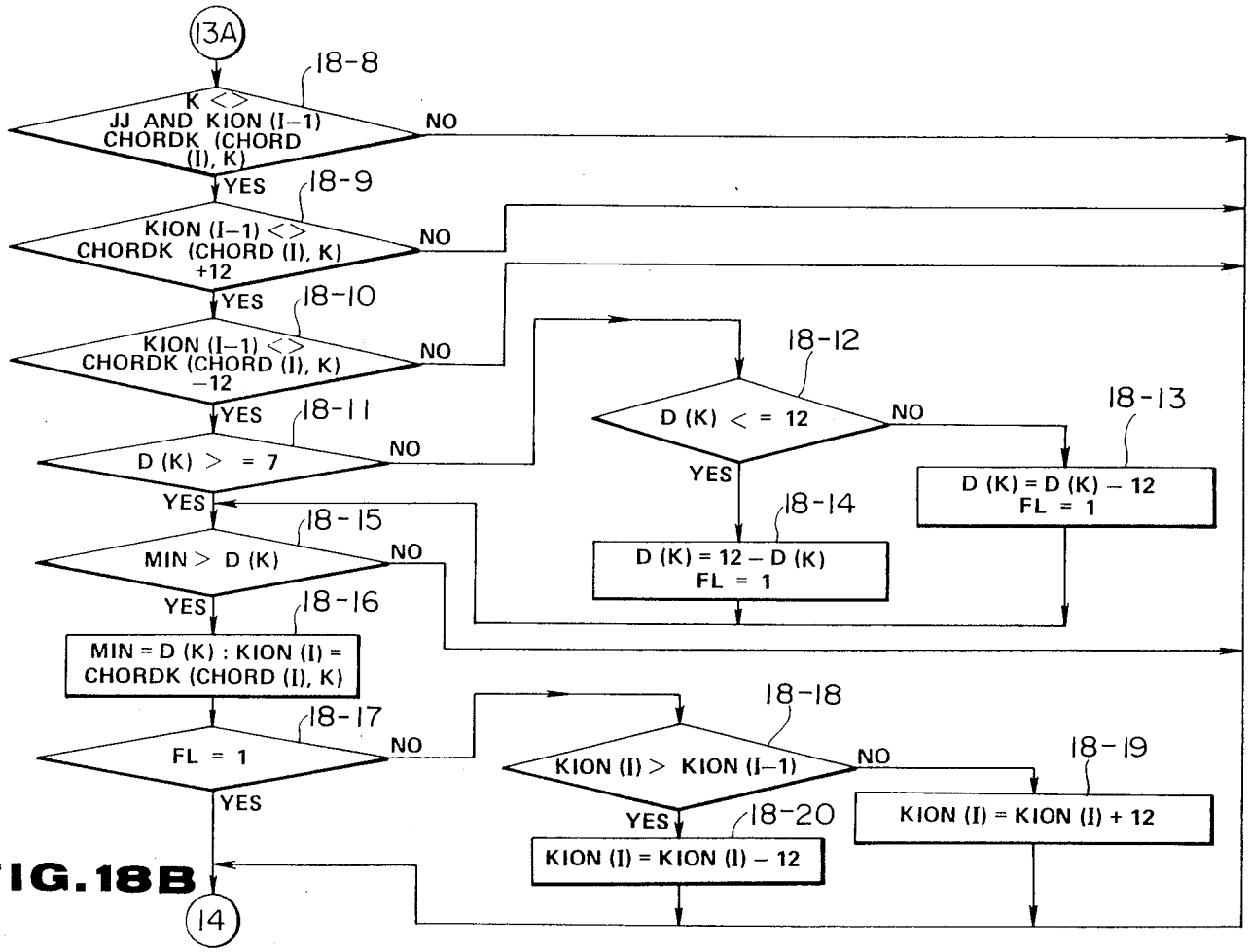

The 12-th inference engine realizes means for applying the perfect 8-th inhibition rule. As shown in the overall routine of FIG. 7, the routine 7-11 of this engine is executed subsequent to the routine 7-10 executed by the 11-th inference engine. If the effective current principal tone from the routine 7-10 by the 11-th inference engine is of the same kind as the main melody tone in the current melody line, the 12-th inference engine 13 functions to alter this provisional current principal tone. Namely, if the perfect 8-th condition exists, the engine infers that the closest tone to the preceding principal tone among the chord members other than perfect 8-th is the current principal toe. FIGS. 18A and 18B exemplify the routine performed by the 12-th inference engine.

Referring to FIGS. 18A and 18B, steps 18-1 through 18-3 are executed by the condition check section of the 12-th engine, and a step 18-4 and following steps are executed by the inferred principal tone generation section. The routine is similar to the routine shown in FIGS. 17A and 17B except for that a condition check in the step 18-3 is different from the condition check in the step 17-2, so detailed description of this routine is omitted.

The routine shown FIGS. 18A and 18B has logic according to which if the provisional current principal tone has the perfect 8-th relation to the current main melody tone, the closest tone to the preceding principal tone among the chord members other than the provisional current principal tone is inferred to be a current principal tone. Alternatively, it is possible to combine the 11-th and 12-th inference engines in such a manner that the 11-th and 12-th condition check sections are coupled by an OR and that the composite inferred principal tone generation section infers the closest tone to the preceding principal tone among the chord members excluding the leading tone in the progressions other than V-I progression and also excluding the tone in the perfect 8-th relation to the main melody tone to be the current principal tone. This modification can be readily realized, and will eliminate the possibility in the case of the cascade connection of the 11-th inference engine to the 12-th inference engine with the latter positioned downstream. The possibility is that of inferring a leading tone (though not a perfect 8-th), to be a principal tone as a result of the operation of the inferred principal generation section of the 12-th inference engine. In other words, the illustrated routine permits this possibility.

The 12-th inference engine (routine 7-11) can alter the provisional current principal tone to a different principal tone on the condition that NO was issued from the condition check section of the 7-th inference engine (routine 7-6) when neither at the start nor at the end of a piece of music, and such a new principal tone is made effective as a determined principal tone (provided there is no subsequent change by the 7-th inference engine). The 12-th inference engine (routine 7-11) is similar to the 11-th inference engine (routine 7-10) and 5-th inference engine (routine 7-4) in that they use a provisional current principal tone. Further, the 11-th inference engine 7-10 absolutely requires melody line data for the perfect 8-th inhibition. On the other hand, the logic of the 9-th and 10-th inference engines 7-8 and 7-9 may be changed to those which do not refer to any melody line data.

13-th Inference Engine

Figure 19:
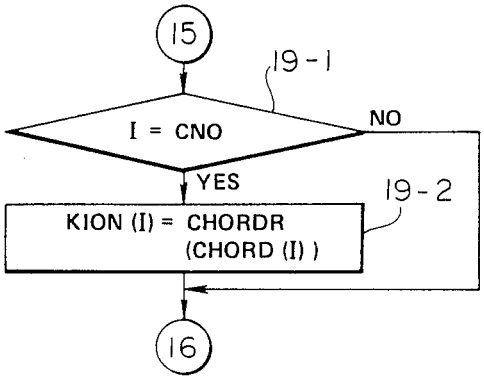
FIG. 19 is a flowchart showing the routine of a 13-th inference engine.

The 13-th inference engine 17 has logic according to which the end of a music piece is made to be a root. FIG. 19 shows the routine 7-12 performed by this 13-th inference engine. A step 19-1 is executed by the conditions check section of this engine, and a step 19-2 is executed by the inferred principal tone generation section of the engine.

The 13-th inference engine infers a root. Also, it is similar to the 1-st inference engine (routine 7-1), 6-th inference engine (routine 7-5) and the first condition check section of the 7-th inference engine (routine 7-6) in that its logic makes reference to the structure and hierarchy of music.

Priority

From the above description the priority ranks of the individual inference engines of the first embodiment has become apparent. The lowest priority rank engine is the 4-th inference engine, then upwardly 6-th, 9-th, 10-th, 11-th and 12-th inference engines follow in the mentioned order. The first, 7-th and 13-th inference engines have the highest priority. The priority order as noted above is by no means limitative.

For example, the priority rank of the 10-th inference engine 14 concerning the V-I progression may be upgraded. More specifically, when the condition check section of the 10-th inference engine has issued YES, the output of the inferred principal tone generation section of the 10-th inference engine (a combination of a leading tone and a tonic) may determine principal tones of two consecutive segments.

Past-Dependency and Independency

Of the inference engines described above, the 4-th inference engine concerning the closest tone extraction has past-dependency. Likewise, the condition check section of the 5-th inference engine refers to past data (i.e., immediately preceding principal tone in the self-line). Also, the 11-th and 12-th inference engine refer to the immediately preceding principal tone in the bass or self line. The first 6-th, 7-th and 13-th inference engines have their logic depending on the structure or remote past part of music. In these engines, the principal tone of the segment of interest is greatly influenced by data of a segment different from the immediately preceding self-line data segment. For the rest, the logic is independent of the past part of music. However, the octave number of the bass principal tone is the immediately preceding segment is used for the coupling of two tones within half of an octave. The octave adjustment may be executed after one or more principal tone pitch names have been determined in each engine. In this case, certain inference engines (particularly those engines with the closest or adjacent tone rule) store a pair of adjacent tones moved up and down from the preceding tone, which are then utilized for the principal tone octave adjustment (i.e., conversion of pitch name to pitch) by selecting the pitch of a closer tone within an allowable bass range. For an inference engine inferring a single principal tone pitch name, the conversion means converts the pertinent pitch name to a pitch coupled within half of octave to the pitch of the preceding principal tone.

TABLE

| Inference engine number | Dependency on preceding principal tone | Use of provisional current tone | Collective principal tone inference for consecutive segments | Reference to melody line | Priorities | Root inference | Dependency on music structure |
|---|---|---|---|---|---|---|---|
| | | | Inference Engines | | | | |
| 1-st | | | | | ① | ○ | ○ |
| 4-th | ○ | | | | ⑧ | | |
| 5-th | ○ | ○ | | | ⑦ | ○ | |
| 6-th | | | | | ⑥ | ○ | ○ |
| 7-th | | | ○ | | ① | | ○ |
| 9-th | | | | ○ | ⑤ | ○ | |
| 10-th | | | ○ | ○ | ④ | | |
| 11-th | ○ | ○ | | | ③ | | |
| 12-th | ○ | ○ | | ○ | ② | | |
| 13-th | | | | | ① | ○ | ○ |

Use of Provisional Current Principal Tone

The 5-th, 11-th and 12-th inference engines are adapted to use provisional current principal tones from upstream positioned inference engines. This structure functions to infer a tone different from the provisional current principal tone to be a principal tone if there is a problem in the provisional current principal tone. That is, it is a sort of exceptional means. In contrast, the 7-th inference engine, for instance, does not use any provisional current principal tone but infers its own principal tone so long as its own internal condition check yields YES. Such a composite character well assimilates the musical knowledge of a man.

Collective Principal Tone Inference for Plural Segments

The 7-th and 10-th inference engines each have logic of collectively inferring principal tones of a plurality of consecutive segments. This logic also well assimilates a way by which a man determines a line. This means inference of not only current but also future principal tones from musical data concerning both the current segment and subsequent (i.e., future) segments, that is, it is of future-regarding type. Further, the 7-th inference engine checks the musical structure (i.e., influence of remote past segments). Hence, this inference engine is of past-regarding type as well.

Consideration of Melody Line

The 9-th, 10-th and 12-th inference engines each have logic, which pays consideration to the melody line, a line different from the bass line. In general, the bass line principal tone determination system pays consideration not only to the self-line but also to a different line

Main Melody Tone

The 8-th inference engine extracts a main melody tone by evaluation from the position and duration of each melody tone. That is, it extracts a most conspicuous tone. This result is utilized by the 9-th, 10-th and 12-th inference engines.

The table above lists the characteristics of the individual inference engines for references.

While the first embodiment, which is a non-real-time bass principal tone determination system, has been described above, it will be obvious that various changes, modifications and improvements of the embodiment are possible. For example, it is readily possible to adopt a priority order other than described above. It is further possible to provide for a user-programmable priority order. Still further, it is possible to permit variation of the priority order with an electronic random number generator. For example, if it is desired that two different inference engines be assigned the same priority, the output of either of these inference engines may be adopted with a 50-% possibility provided by the random number generator during the operation.

Furthermore, the invention is also applicable to principal tone generation for an accompanimental line other than the bass line.

Figure 20:
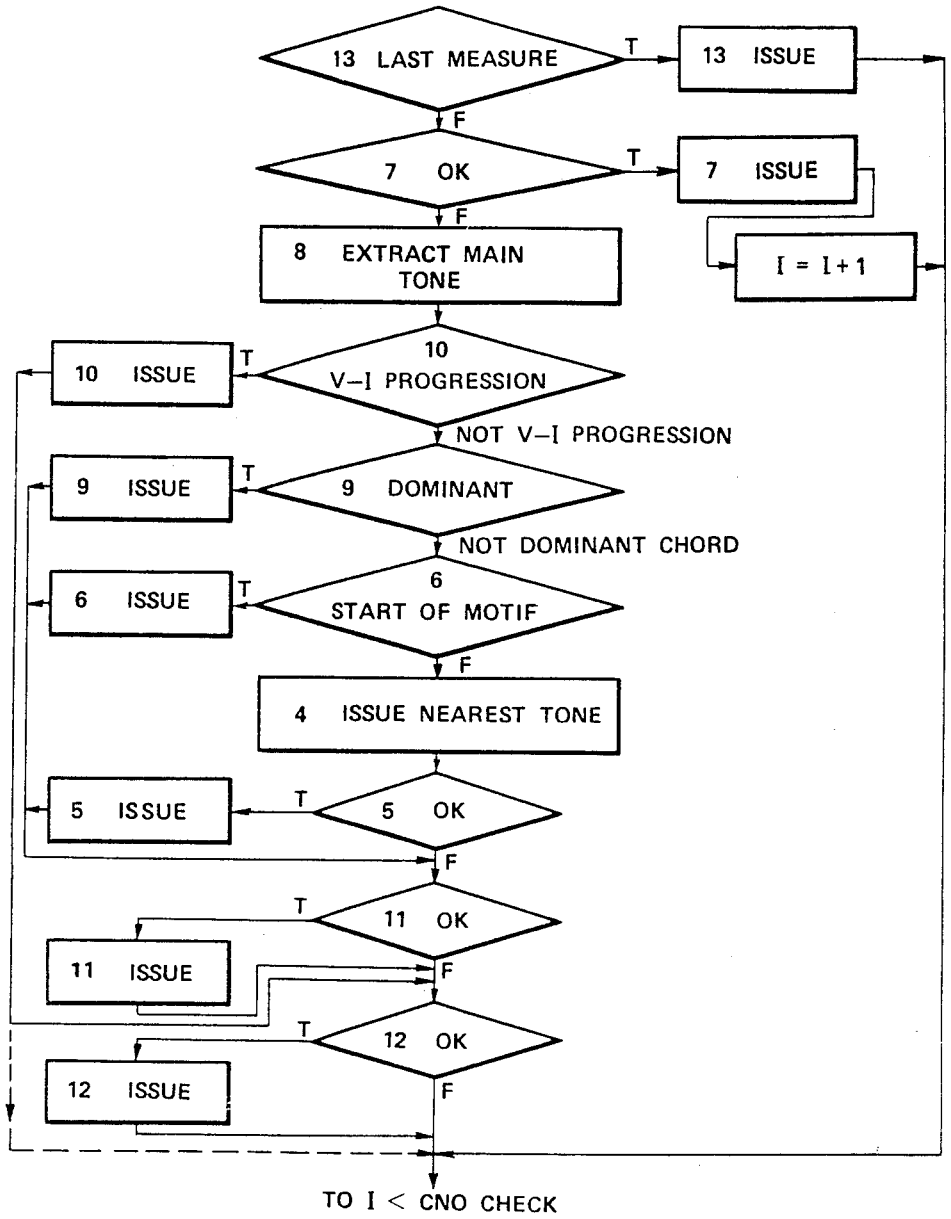
FIG. 20 is a flowchart substantially equivalent to the routine shown in FIG. 7.

For the sake of reference, FIG. 20 shows a bass principal tone determination routine which is substantially equivalent to the routine shown in FIG. 7. In the figure, numerals in circles designate the numerals of inference engines, rhomboid blocks show steps executed by the condition check sections of the inference engines of the corresponding numerals, and rectangular blocks show steps executed by the inferred principal tone generation sections of the inference engines of the corresponding numerals.

SECOND EMBODIMENT

A second embodiment will now be described. In this embodiment, the invention is applied to a real-time bass line principal tone generation system. It is assumed that a melody line is input a real-time data from a music input device, and also a chord progression is real-time input from music input device. An environment is assumed, in which reference can be made only to past data in a strict sense (i.e., data provided from the music input device).

Overall Arrangement

Figure 21:
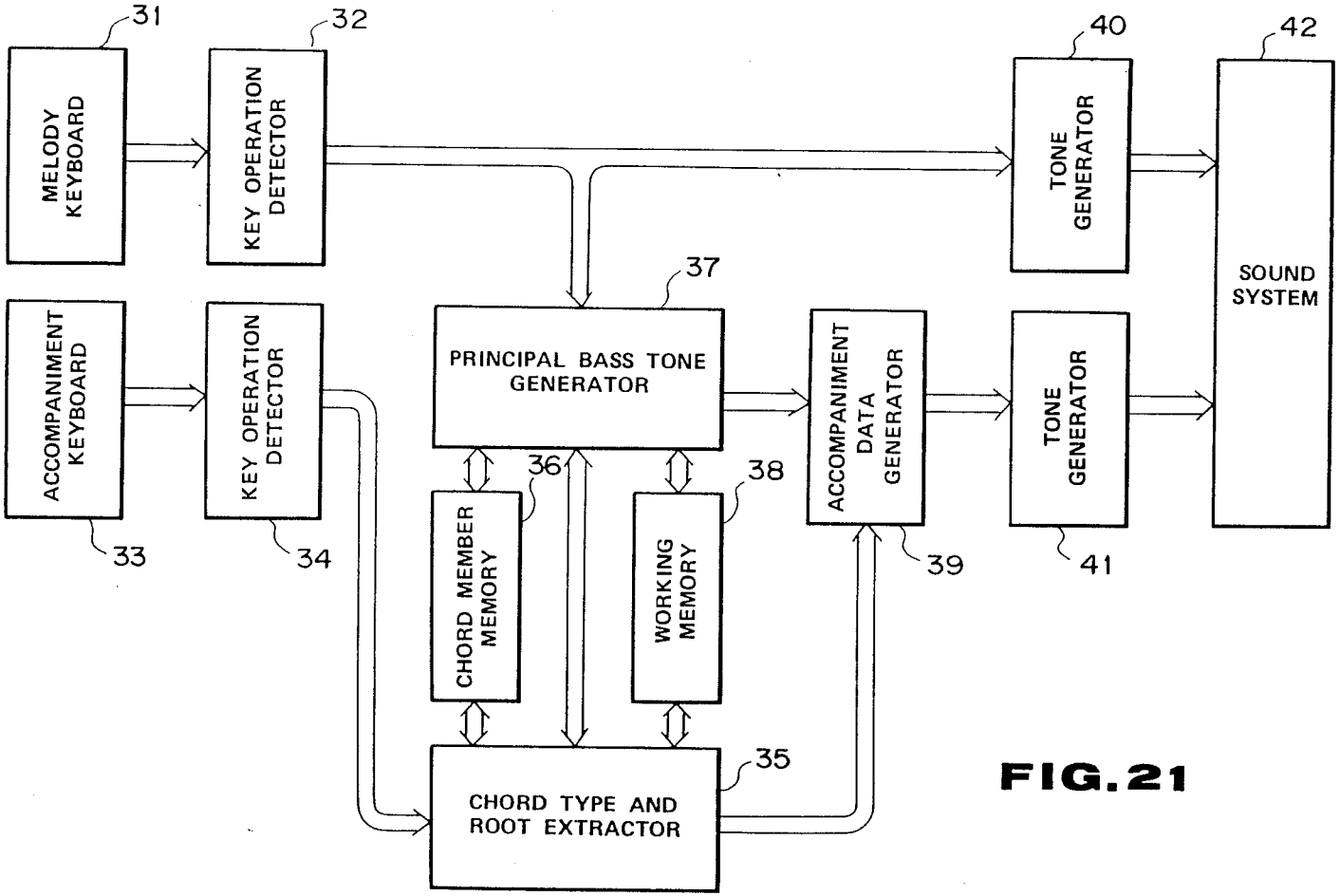
FIG. 21 is a block diagram of an electronic musical instrument incorporating a second embodiment of the invention.

FIG. 21 shows the overall arrangement of an electronic musical instrument incorporating the second embodiment of the invention. Referring to the figure, the instrument comprises a melody keyboard 31, a key operation detector 32 for detecting the depression of keys, an accompaniment keyboard 33, and an operation detector 34 for detecting the depression of keys of this keyboard. The components noted above constitute a music input device of the keyboard type. Reference numeral 35 designates a chord type/root extractor for determining chord type and root from accompaniment key data. Reference numeral 36 designates a chord member memory, in which data concerning chord members of a set of chords prepared in the system are stored. The stored data are used in the chord type/root extractor 35 for matching against accompaniment key data and also used in a principal bass tone determination process executed by a principal bass tone generator 37. If the chord type/root extractor 35 does not find any pertinent chord, it issues the accompaniment key data as such to an accopaniment data generator 39.

The principal bass tone generator 37 is a significant part of this embodiment, and it determines principal bass tones one at a time. For the determination of the principal bass tone, the principal bass tone generator 37 makes reference to melody tones from the melody keyboard 31 as melody source, present and past chord data, past principal tone data, etc. These data are temporarily stored in a work memory 38. The principal bass tone determined by the principal bass tone generator 37 is supplied to the accompaniment data generator 39. The accompaniment data generator 39 supplies data of principal bass tones as long as chords are detected but it supplies accompaniment key data in failure of chord detection. It may control proper timing of tones if desired. A tone generator 40 receives data from the melody keyboard as source, i.e., melody key data and generates melody tones.

The melody tone data from the tone generator 40 and bass tone data from the tone generator 41 are supplied to a sound system 42 for amplification and conversion into acoustic signals.

As will be described later, the principal bass tone 37 has logic for selecting a root as the first principal bass tone of music first principal tone inference engine), logic of inferring a chord member closest or adjacent to the preceding principal bass tone as a current principal bass tone (second principal inference engine), logic of inferring that, when the immediately preceding tone was stepped in a direction from the one before that tone and the current chord has a member moved stepwise in the same direction from the immediately preceding tone, that member is the current principal tone (third principal tone inference engine), logic of inferring that, when a provisional current principal tone is in a perfect 8-th relation to (i.e., of the same pitch name as) the current melody tone, the closest one of the other chord members to the preceding principal tone is the current principal tone (fourth principal tone inference engine), logic of inferring that, when the current chord is a minor chord and the provisional current principal tone is a root or a third (lowest tone in the first inversion), the closest one of the other chord members to the preceding principal tone is the current principal tone (fifth principal tone inference engine) and logic of controlling priority order among these principal tone inference engines.

Preliminaries

In this embodiment, the following main variables are used:

KION (I): Principal bass tone in segment I

CHORD (I): Chord type in segment I

CHORDR (CHORD (I)): Chord root in segment I

CHORDN (CHORD (I)): Number of chord members in segment I

CHORDK (CHORD (I), J): J-th chord member in segment I

IN (I, SS): Melody tone

MKCmax: Highest pitch among melody key data

BC: Measure counter

CHECK: Flag indicating whether or not a principal tone is to be determined

CH: Chord type detected by the chord type-root extractor

The form of data concerning the pitch and chord may be the same as in the previous first embodiment. More particularly, pitch data is in the form of integers changed by one for every chromatic scale semitone, and data of the number and pitches of the individual chord members are stored in the chord member memory.

Main Routine

Figure 22:
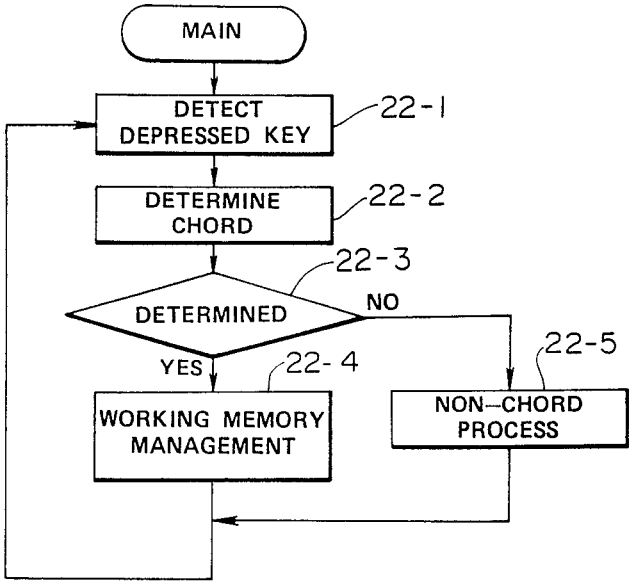
FIG. 22 is a flowchart showing the main routine of the second embodiment.

FIG. 22 exemplifies the main routine of the electronic musical instrument incorporating the second embodiment. In a step 22-1 accompaniment key data detected by the key operation detector 34 is read out, and in a step 22-2 the chord type/root extractor 35 identifies the read accompaniment key data in terms of the root and type of chord by searching the data of the chord member memory 36. If a pertinent chord is found, the historical data in the work memory 38 (i.e., chord data and principal tone data) are updated. If no pertinent chord is detected, a non-chord process well known in the art is executed in a step 22-5.

Interrupt Routine

In this embodiment, the determination of principal tone is performed in an interrupt routine which is executed at a time interval related to the system resolution. FIG. 22 exemplifies this routine. In a step 23-1, a check is done as to whether or not a principal tone is to be determined. If it is to be determined, a principal tone determination process (step 23-2) is executed before the system returns to the main routine. If there is no need of determining any principal tone, the system immediately returns to the main routine. The timing of the determination of the principal tone is described hereinbelow.

Work Memory Management

Figure 24:
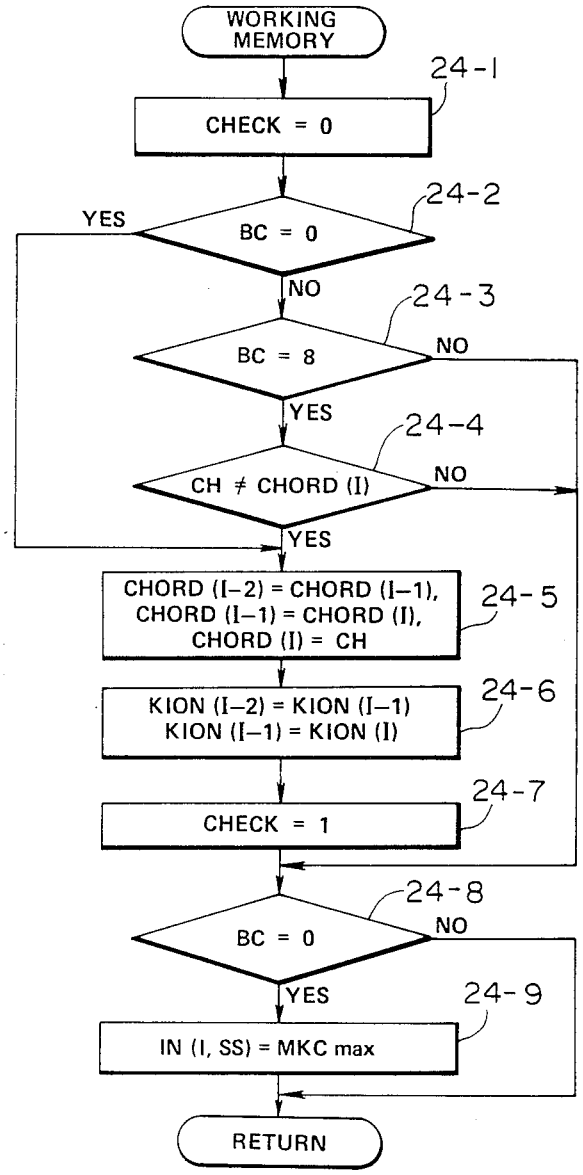
FIG. 24 is a flowchart showing a work memory management routine.

FIG. 24 exemplifies the details of the memory work management step 22-4 in the main routine (FIG. 22).

In this routine, a check flag of chord and principal tone data are updated. If the flag "CHECK" is "1", it is time to determine a principal tone as seen from a check routine shown in FIG. 25. That is, CHECK=1 represents a request for the principal tone determination.

The check flag "CHECK" becomes "1" under the following condition:

The newly detected chord CH is different from the previous chord CHORD (I);

(A) at the measure start (BC=0), or (B) at the 3-rd beat (BC=8) (4 beats per measure being assumed).

The above condition check and updating of the check flag are done in steps 24-2 through 24-4 and 24-7. In a step 24-5 a series of chord data is updated, and in a step 24-6 a series of principal tone data is updated. For example, the data KION (I) of the principal tone in segment I is transferred to the principal tone KION (I-1) of the preceding segment (I-1). In the steps 24-5 and 24-6 data for the past two segments (I-2) and (I-1), as well as the current (I) are stored for use in the inference by passing bass tone inference engine (third engine) to be described later.

Further, at the start of a measure (BC=0), the highest pitch data MKCmax among the melody key data is set in IN (1, SS) which is used by a perfect 8-th inhibition principal tone inference engine in the principal bass tone generator 37.

Check

Figure 23:
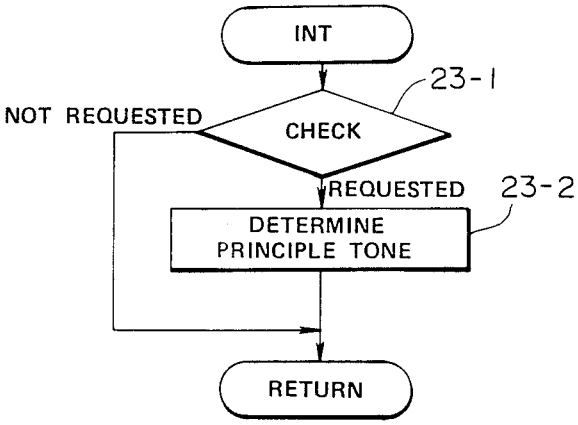
FIG. 23 is a flowchart showing a principal tone determination routine.
Figure 25:
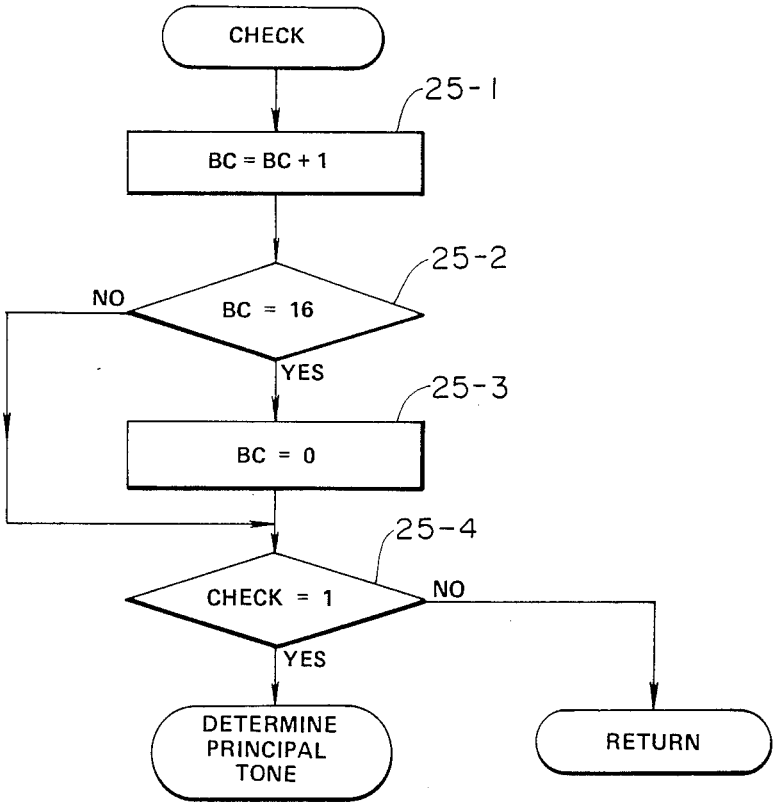
FIG. 25 is a flowchart showing a check routine.

FIG. 25 exemplifies the details of the check step 23-1 in FIG. 23. Steps 25-1 through 25-3 constitute a measure counter updating process. One measure is regarded to be "16". In a step 25-4 the flag CHECK is checked. If CHECK =1, the system goes to the principal tone determination routine, and otherwise it returns to the main routine.

Now, the individual principal tone inference engine in the principal tone generator 37 and priority control of these engines will be described.

First Principal Tone Inference Engine

Figure 26:
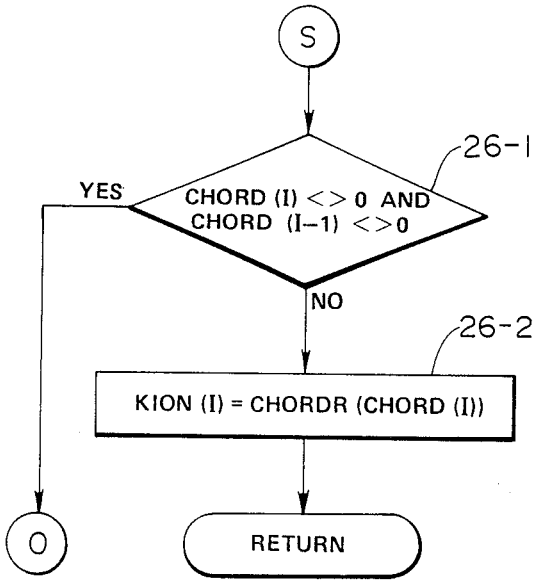
FIG. 26 is a flowchart showing the routine of a first inference engine.

FIG. 26 exemplifies the detailed routine executed by the first principal tone inference engine. The first principal tone inference engine infers the chord root to be a principal tone at the start of music (see step 26-2). The start of music is signaled by the first chord extracted from the key data input from the accompaniment key data 33. Here, it is checked in a step 26-1 whether there is a chord in CHORD (I) register (which was cleared initially like the other registers) but CHORD (I-1) is still in a cleared state.

The step 26-1 is executed by a condition check section of the first principal tone inference engine and the step 26-2 is executed by an inferred principal tone generation section of the engine. Subsequent to the routine 26-2, the system returns to the main routine. Thus, the first principal tone is determined to be a root.

2-nd Principal Tone Inference Engine

Figure 27:
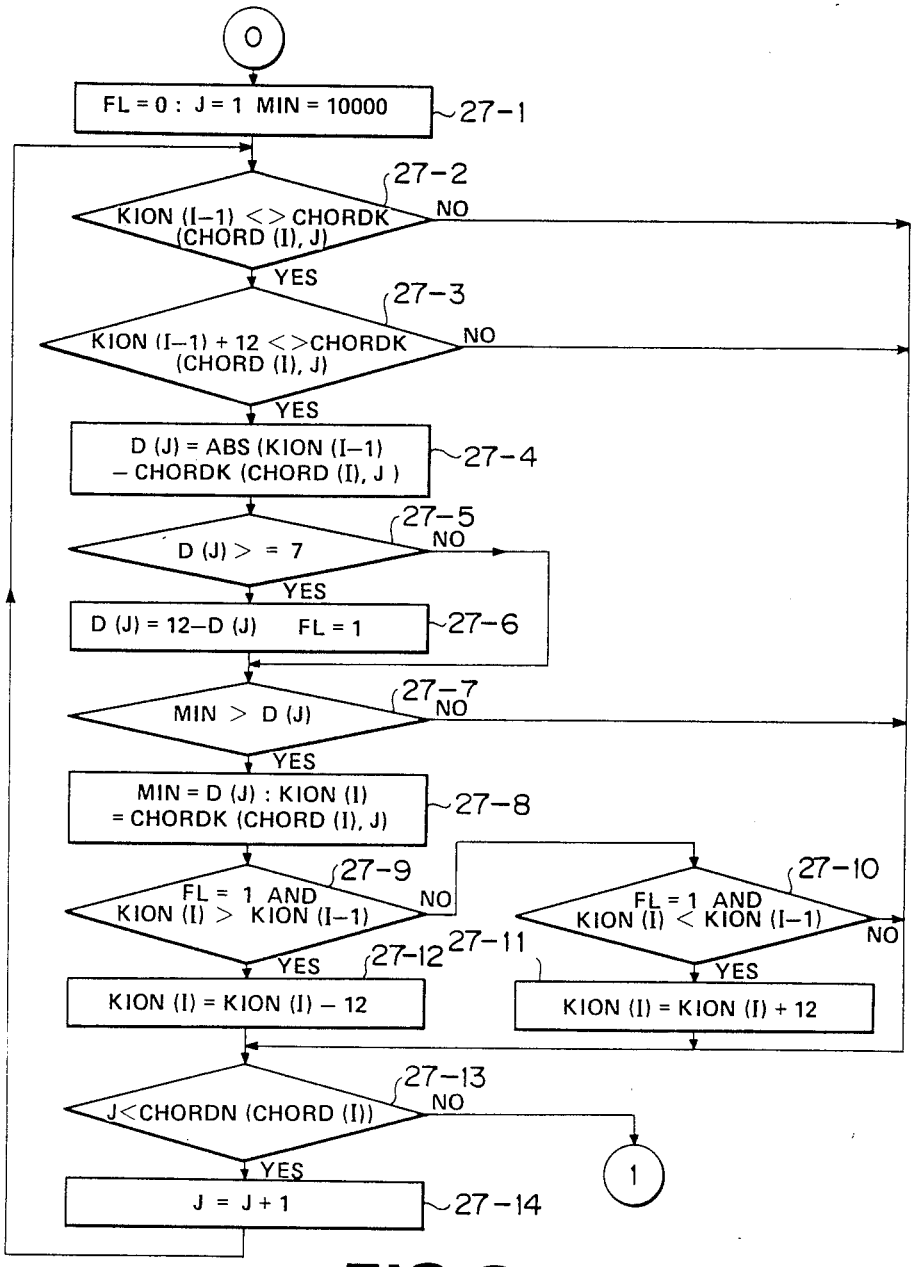
FIG. 27 is a flowchart showing the routine of a 2-nd principal tone inference engine.

FIG. 27 exemplifies the detailed routine executed by the 2-nd principal tone inference engine.

The 2-nd principal tone inference engine is rendered operative in the second or subsequent segments. It infers the closest chord member to the preceding principal tone (i.e., most adjacent tone) to be a principal tone. Steps 27-2 and 27-3 constitute a process for excluding a chord member of the same pitch name as the preceding principal tone KION (I-1) from the subject of the closest tone search. In this example, pitches are compared, but it is also possible to compare pitch names.

The following calculations

A=(KION (I-1) MOD 12) and

B=(CHORDK (CHORD (I), J) MOD 12) are done, and if A=B, the compared pitch names are the same.

In a step 27-4, the pitch difference between the preceding principal tone and J-th chord member is calculated. If this difference is greater than the half of octave, there holds D (J)≧7 in a step 27-5. The range of D (J) is assumed to be 1≦D (J)≦11. This imposes a restriction on the line tone range. If the difference is greater than half of an octave, a step 27-6 is executed in which a complement of D (J) to 12 is computed and "1" is set in an octave adjustment flag FL.

In a step 27-7 it is found that MIN is greater than D (J) if the chord member of interest is the closest so far. At this time, MIN is updated by D (J), and the pitch of the J-th chord member is set in KION (I) (step 27-8). Steps 27-9 through 27-12 constitute an octave adjustment process for the current principal tone KION (I). As a result, the current principal tone is rendered to have an interval within half of an octave from the preceding principal tone KION (I-1).

Instead of the process of steps 27-4 through 27-12, the principal tone of interest may be evaluated in the interval from the preceding principal tone before conversion to the pitch. For example, the difference $$U(J)=B-A$$

between the pitch name B of the J-th chord member noted above and pitch name A of the immediately preceding principal tone is calculated, and then DN (J)=−(complement of U (J) to 12) is calculated (for instance, DN (J)=−7 if U (J) is 5 and DN (J)=+7 if U (J)=−5. Then, the absolute values of U (J) and DN (J) are compared. If $$\text{ABSU (J)} \geqq \text{ABSDN (J)},$$

calculations $$D(J)=ABSDN(J) \text{ and}$$

$$d(J)=DN(J)$$

are executed, and if $$\text{ABSU (J)} < \text{ABSDN (J)},$$

calculations $$D(J)=ABSU(J) \text{ AND}$$

$$d(J)=U(J)$$

are executed As a result, the smaller one of the pitch difference between A and B with A positioned higher than the reference B and the pitch difference between A and B with A lower than B is set in D (J), and an interval of the current principal tone candidate relative to the preceding principal tone is set in d (J).

If a condition $$\text{MIN} > \text{D (J)}$$

is satisfied in the search for MIN (least value), calculations $$\text{MIN}=D(J) \text{ and}$$

$$V=d(J)$$

are executed.

In the last pitch conversion, a calculation $$\text{KION (I)}=\text{KION (I-1)}+V$$

is executed to obtain the pitch of the current principal tone.

Additionally, there may be provided a tone range check section which checks whether the pair of principal tone candidates with one higher than and closest to the previous principal tone and the other lower than and closest to the previous tone are in the allowable range. If, for example, the higher candidate is beyond the upper limit of the range, the lower candidate is selected to be the current principal tone.

It is to be understood that steps 27-7 through 27-13 are only exemplary.

If it is found in step 27-13 that J=CHORDN (CHORD (I)), the check of all the chord members is over, thus bringing an end to the routine of the first principal tone inference engine. At this time, the closest tone to the preceding principal tone KION (I-1) is stored in KION (I).

3-rd Principal Tone Inference Engine

Figure 28:
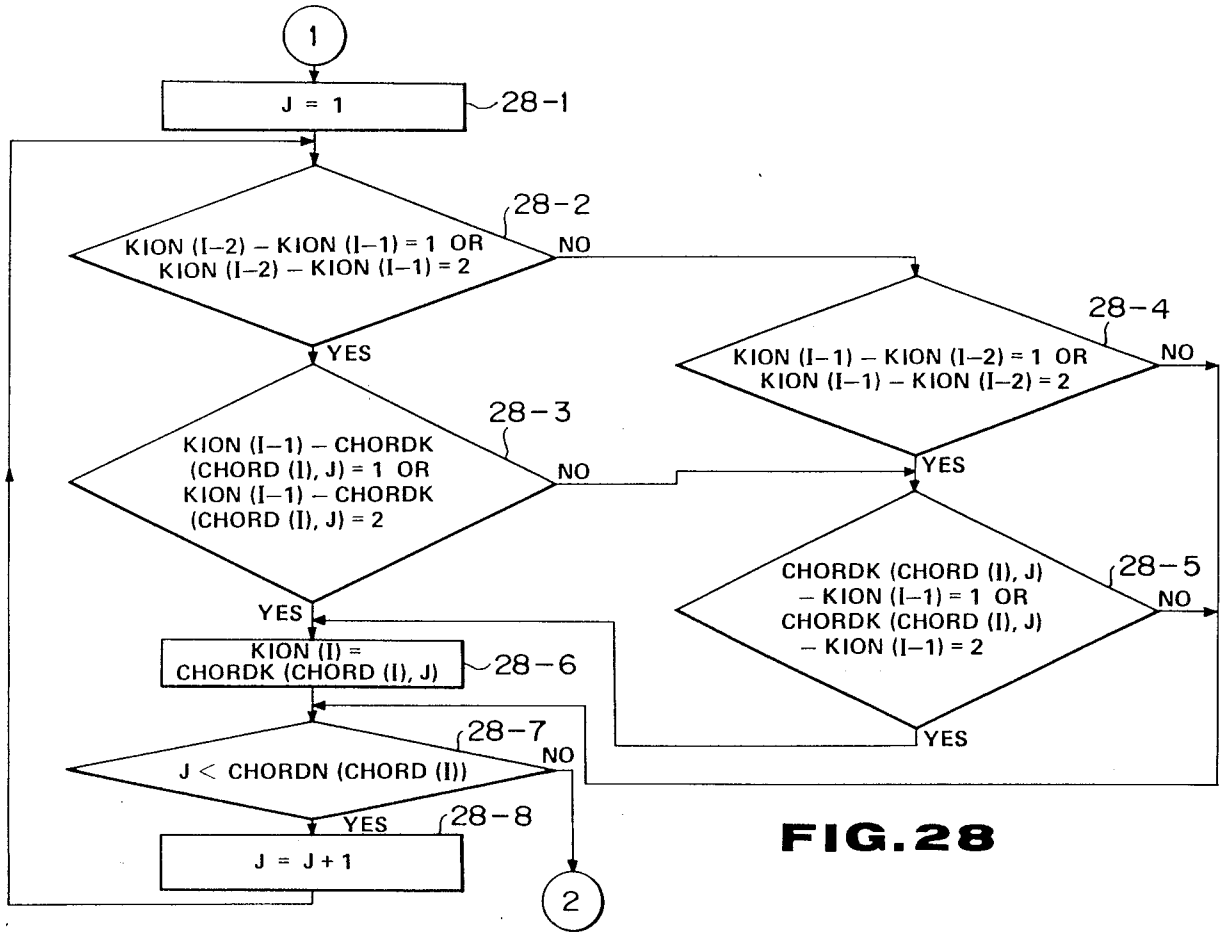
FIG. 28 is a flowchart showing the routine of a 3-rd principal tone inference engine.

FIG. 28 shows the detailed routine executed by the 3-rd principal tone inference engine. The purpose of this engine is to generate a passing tone bass line. In its logic, reference is made to the immediately preceding principal tone (last tone) and the principal tone before the last tone, and if the last principal tone was moved stepwise in a certain direction (up or down) from the last but one principal tone, and if the current chord includes a member stepped in the same direction from the last principal tone to make it a passing tone, then that member is inferred to be the current principal tone.

A step 28-2 is to check whether the last principal tone KION (I-1) was stepped "down" from the last but one principal tone KION (I-2). A step 28-3 is to check whether the J-th chord member is stepped "down" from the last principal tone. Likewise, a step 28-4 is to check whether the last principal tone was stepped "up" from the last but one principal tone. A step 28-5 is to check whether the J-th member of the current chord is stepped "up" from the last principal tone. If both the checks in the steps 28-2 and 28-3 yield YES, or if both the checks in the steps 28-4 and 28-5 yield YES, the passing tone condition is met, and the J-th chord member is inferred to be the current principal tone KION (I) (step 28-6). If no passing tone condition exists, J is incremented, and passing tone condition check is done with respect to the next chord member. If J reaches the number of chord members, the routine is ended.

Instead of the progression check based on pitches in the steps 28-3 and 28-5, it is possible to make a check based on pitch names.

For example, the pitch name X of the pitch KION (I-1) of the last principal tone and the pitch name Y of the J-th chord member CHORDK (CHORD (I), J) are calculated (X=0 to 11, Y=0 to 11), the difference C1

$$\text{C1}=X-Y\ (-11 \leqq \text{C1} \leqq 11)$$

between the pitch name Y of the member and pitch name X of the principal tone is calculated, and a calculation $$\text{C2}=-(\text{complement of C1 to 12})$$

is made (where C2 is negative when C1 is positive and it is positive when C1 is negative. For example, C2=−1 is calculated when C1=11, and C2=+1 when C1 =*11*). The smaller one of the absolute values of C1 and C2 is substituted for V to make a check of $$V=1, 2$$

in a step corresponding to a step 28-3, and make a check of $$V=-1, -2$$

in a step corresponding to a step 28-5,

Likewise, instead of the step 28-6

$$KION\ (I)=KION\ (I-1)+V$$

is calculated. V represents the pitch interval of the stepwise motion from the last principal tone to the current principal tone.

In this embodiment, the 3-rd principal tone inference engine is rendered operative subsequent to the 2-nd principal tone inference engine. If a passing tone condition holds, a new principal tone which makes the immediately preceding tone a passing tone is generated. Otherwise, the principal tone inferred by the 2-nd principal tone inference engine is still effective. The 3-rd principal tone inference engine functions to permit generation of two or more consecutive passing tones as well as a single passing tone. A unique point is that not only the last principal tone but also the last but one principal tone are used to determine the current principal tone. More generally, the 3-rd principal tone inference engine controls an accompaniment line to depend on past data for two or more consecutive segments.

4-th Principal Tone Inference Engine

Figure 29:
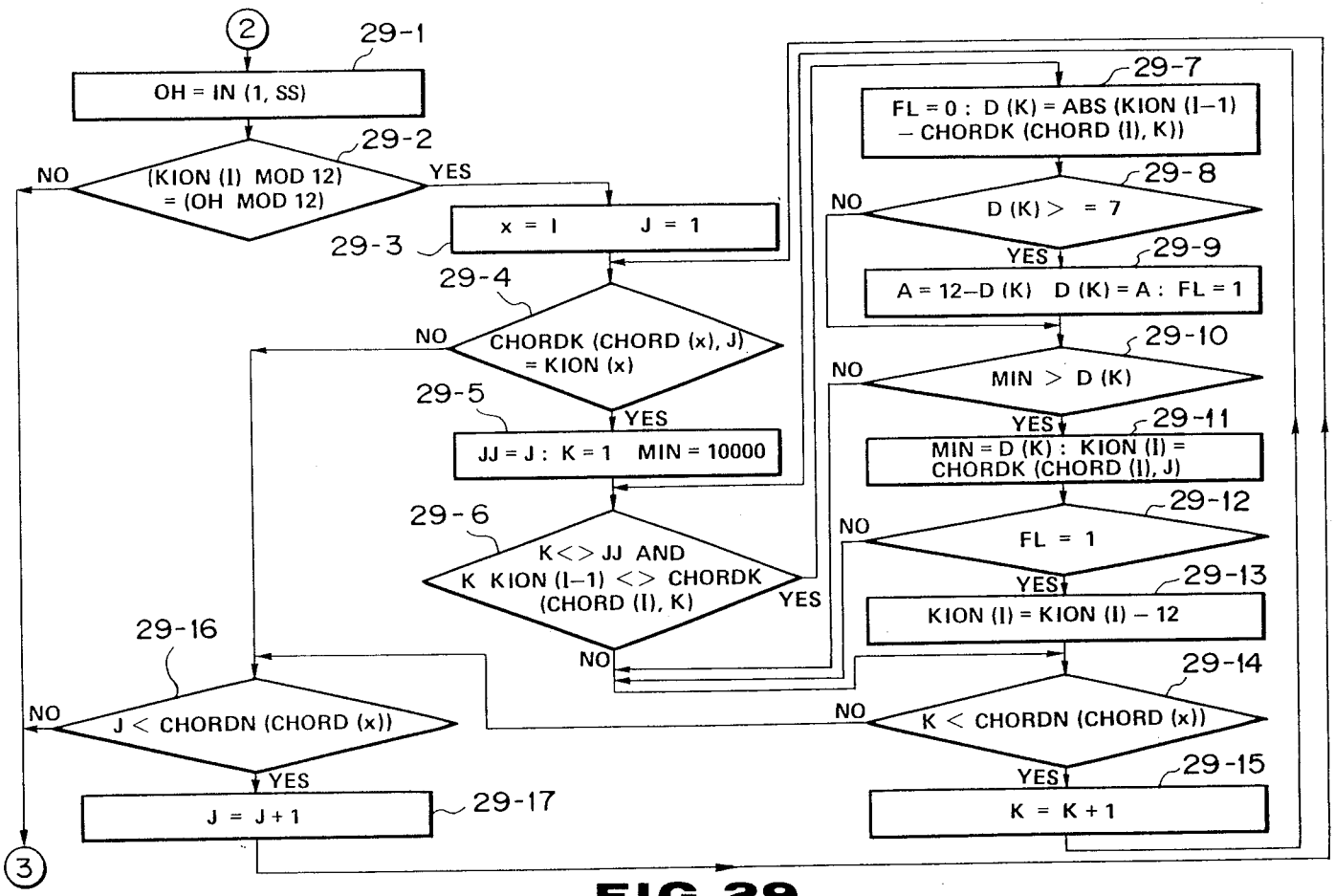
FIG. 29 is a flowchart showing the routine of a 4-th principal tone inference engine.

FIG. 29 exemplifies the detailed routine of the 4-th principal tone inference engine. In this embodiment, the 4-th principal tone inference engine is rendered operative subsequent to the 3-rd principal tone inference engine. The purpose of the 4-th principal tone inference engine is to infer that, when the current melody tone and provisional current principal tone are in a perfect 8-th relation (of the same pitch name), the closest tone among the current chord members excluding the provisional current principal tone to be the current principal tone. Since the 4-th principal tone inference engine is positioned downstream of the 3-rd principal tone inference engine, the provisional current principal tone used by the 4-th engine is a tone inferred by the 3-rd or prior principal tone inference engine.

In FIG. 29, IN (1, 55) shown in a step 29-1 represents a melody tone. More specifically, IN (1, SS) is the highest pitch tone among melody key data existing at the time of the principal tone determination routine (here the time of the start of the measure). This tone is set in OH. In a step 25-2, a check is done as to whether this OH is in a perfect 8-th relation to the provisional current principal tone KION (I). These steps 25-1 and 25-2 are executed by the 4-th condition check section. If there exists the perfect 8-th relation, a step 29-3 and following steps are executed by the 4-th inferred principal tone generation section. If no such a relation exists, the provisional current principal tone is still effective.

In a step 29-4, a check is done as to whether the J-th chord member coincides with the provisional current principal tone. If the two tones are not coincident, J is incremented (step 29-17), and the next chord member is compared. The coincident chord member is saved in JJ in a step 29-5. In a step 29-6, a check is done as to whether the K-th chord member is neither the JJ-th chord member nor of the same pitch name as the immediately preceding principal tone. If the check yields YES, an adjacent pitch tone search in a step 29-7 and the following steps is performed. In steps 29-4 and 29-6 pitches are compared, but it is also possible to make comparison of pitch names by calculating pitch modulo one octave (=12), i.e., the remainder when the pitch data is divided by 12.

In a step 29-7, the difference D (K) between the preceding principal tone and K-th chord member is obtained. In steps 29-9 and 29-10 an octave check is done and an octave shift flag FL is selectively set. If it is found in a step 29-10 that K-th chord member is closer to the preceding principal tone, a step 29-11 is executed, in which the K-th chord member is inferred to be the current principal tone KION (I). In steps 29-12 and 29-13, an octave shift of the current principal tone is executed by reference to the flag FL. As a result, the inferred principal tone KION (I) is coupled within half of an octave to the preceding principal tone KION (I-1). Instead of the process of steps 29-7 through 29-15, it is possible to infer the closest tone in the pitch name and then convert the pitch name to the pitch.

If it is found in a step 29-14 that K=CHORDN (CHORD (I)), the closest tone to the preceding principal tone KION (I-1) among the chord members exclusive of the provisional current principal tone of the same pitch name as melody tone OH has been stored in KION (I).

It is to be understood that the 4-th principal tone inference engine uses the provisional current principal tone and, when the provisional current principal tone is in a predetermined relation to the melody tone, it infers a different current principal tone.

5-th Principal Tone Inference Engine

Figure 30:
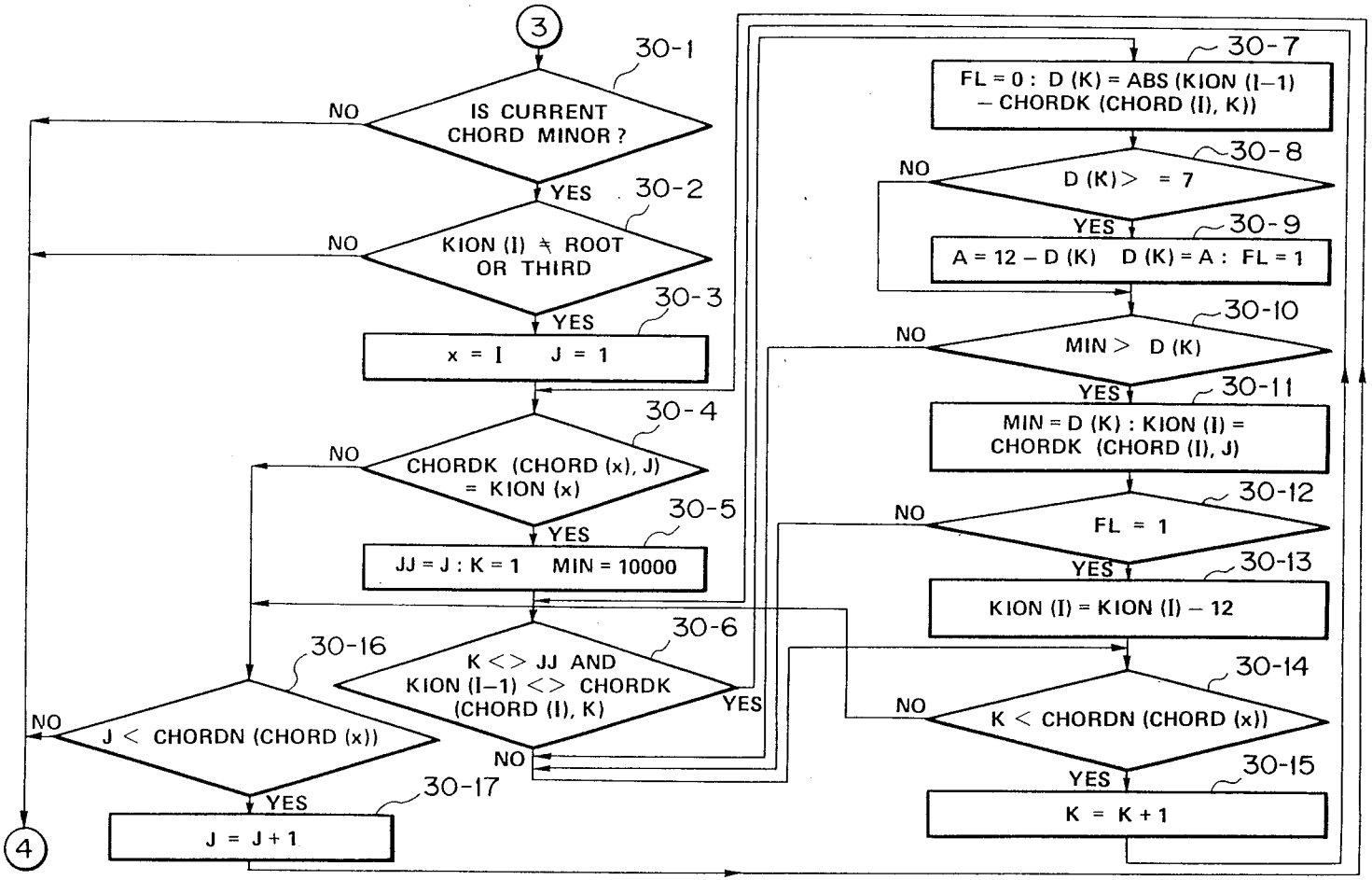
FIG. 30 is a flowchart showing the routine of a 5-th principal tone inference engine.

FIG. 30 exemplifies the detailed routine by the 5-th principal tone inference engine. In this example, the 5-th principal tone inference engine is rendered operative subsequent to the 4-th principal tone inference engine. The purpose of the 5-th principal tone inference engine is to infer that, when the current chord is a minor chord and the provisional current principal tone is neither a root nor third, the closest tone to the preceding principal tone among the chord members other than the provisional current principal tone is the current principal tone.

Steps 30-1 and 30-2 are executed by the condition check section of the 5-th principal tone inference engine, and steps 30-3 through 30-17 are executed by the inferred principal tone generation section. Steps 30-3 through 30-17 is similar to the steps 29-3 through 29-17 in FIG. 29, so that they are not described in detail.

In this embodiment, the 5-th principal tone inference engine is positioned downstream of the 4-th principal tone inference engine. These two engines can be integrated, however. For example, the two condition check sections are coupled together by an OR gate. To obtain the current principal tone, the composite principal tone generation section searches for the closest tone among chord members other than the one in perfect 8-th relation to the melody tone, and when the current chord is a minor, it selects the closer one of the root and third chord members provided that neither the root nor third is in perfect 8-th relation to the melody tone.

When the routine of the 5-th principal tone inference engine is over, the system returns to the ordinary main routine.

After Determination of Principal Tone

The principal tone data generated (determined) in the principal tone generator 37 is supplied to the accompaniment data generator 39. The latter may convert the data into an accompaniment chord with the principal tone positioned the lowest. In such a case, the chord data is also supplied from the generator 37 to the generator 39. The accompaniment data generated in the generator 39 is delivered to the tone generator 41 which, in turn, forms a corresponding tone signal The output of the tone generator 3 is supplied to the sound system 41 for final conversion into an acoustic signal.

Summary of the Second Embodiment

From the above description the features of the second embodiment will be understood Some of the features are given below.

(a) The principal bass tone generator 37 includes a plurality of different principal tone inference engines and means for controlling the priority order among these plurality of principal tone inference engines. Therefore, rich and integrated musical knowledge can be well expressed.

(b) The lowest priority rank is given to the second principal tone inference engine for inferring a principal tone in conformity to the closest tone rule, and the other principal tone inference engines act to correct the closest tone rule.

(c) Certain principal tone inference engines have logic of using the provisional current principal tone to selectively infer a different current principal tone. Some principal tone inference engine here logic of independently inferring a current principal tone if an internal condition is satisfied. This complex logic is thought to well represent musical knowledge of men as a whole.

(d) The 3-rd principal tone inference engine infers the principal tone of the current segment by reference not only to the self-line data of the immediately preceding segment but also to the self-line data of a plurality of preceding consecutive segments. The other principal tone inference engine (excluding the first engine) have a character depending on the self-line data of the immediately preceding segment.

(e) There are provided principal tone inference engines which pay consideration to melody line data The 4-th and 5-th principal tone inference engines do so. In other words, principal tones are inferred while listening to a different line, which well represents a feature of performance by a skilled player.

(f) There is a principal tone inference engine which pays consideration to the chord type. The 5-th principal tone inference engine does so. The search range of principal tones to be inferred is limited by the chord type.

While preferred embodiments of the invention have been described in the foregoing, it will be obvious to one in the art that various changes and modifications can be made without departing from the scope and spirit of the invention. Hence, the scope of the invention should be defined only by the accompanying claims.

What is claimed is:

1. A system for determining a principal tone for each of a plurality of segments of an accompaniment line, in an environment wherein data of music are provided before said principal tone is determined, comprising:

hierarchic structure means for defining, as at least part of said data of music, a hierarchic structure of segments of music; and principal tone inference means for generating an output signal based on inferring a principal tone for a segment of interest among said segments of music, in accordance with said hierarchic structure defined by said hierarchic structure means, whereby a principal tone is determined by said principal tone inference means for each of said plurality of segments of the accompaniment line.

2. The system of claim 1, wherein:

said hierarchic structure means includes means for defining a past segment of music having the same hierarchic level as a segment of interest; and said principal tone inference means includes means for inferring a principal tone of said segment of interest in a form dependent on a principal tone determined for said past segment having the same hierarchic level as said segment of interest.

3. The system of claim 2, wherein:

a piece of music includes segments each having the same hierarchic level as an immediately preceding segment, and other segments each having the same hierarchic level as a like segment in a like musical phrase; and said principal tone inference means includes:

immediate dependent inference means for inferring, when a segment of interest has the same hierarchic level as the immediate preceding segment, a principal tone for said segment of interest by reference to a principal tone determined for said immediately preceding segment; and past phrase dependent inference means for inferring, when a segment of interest has the same heirarchic level as a like segment in a like musical phrase, a principal tone for said segment of interest to be tone related to the principal tone determined for said related segment in the past.

4. The system of claim 3, wherein the first and last segments of a piece of music are assigned the highest hierarchic level; and said principal tone inference means includes means for inferring, when a segment of interest is said first or last segment of said piece of music, a principal tone for said segment of interest to be a root.

5. The system of claim 1, wherein:

said hierarchic structure means includes musical form memory means for storing a type of each musical phrase and a first segment number of each musical phrase; and said principal tone inference means includes:

segment matching means for reading out data of said musical form memory means and for checking as to whether a segment of interest is a first segment of a musical phrase of a certain type; and executing means for inferring, when it has been found by segment matching means that said segment of interest is said first segment of said musical phrase of a certain type, a tone related to a principal tone determined for a first segment of a past musical phrase of a related type to be a principal tone for said segment of interest.

* * * * *

UNITED STATES PATENT AND TRADEMARK OFFICE

CERTIFICATE OF CORRECTION

PATENT NO. : 4,977,812

DATED : December 18, 1990

INVENTOR(S) : M. INO

It is certified that error appears in the above-identified patent and that said Letters Patent is hereby corrected as shown below:

Title page, Abstract, line 4:

Change the word "after" to --infer--.

Signed and Sealed this

Tenth Day of November, 1992

*Attest:*

DOUGLAS B. COMER

*Attesting Officer*

*Acting Commissioner of Patents and Trademarks*